US012660882B1

(12) United States Patent
Huang

(10) Patent No.: US 12,660,882 B1
(45) Date of Patent: Jun. 23, 2026

(54) THREE-DIMENSIONAL CURVED SURFACE AIR CUSHION MODULE AND CURVED SURFACE AIR CUSHION PRODUCT

(71) Applicant: Ying-Chun Huang, Nantou County (TW)

(72) Inventor: Ying-Chun Huang, Nantou County (TW)

( * ) Notice: Subject to any disclaimer, the term of this patent is extended or adjusted under 35 U.S.C. 154(b) by 0 days.

(21) Appl. No.: 19/000,584

(22) Filed: Dec. 23, 2024

(51) Int. Cl.
*A43B 13/20* (2006.01)
*A43B 13/18* (2006.01)
*A47C 27/08* (2006.01)

(52) U.S. Cl.
CPC ..... *A43B 13/20* (2013.01); *A43B 13/187* (2013.01); *A47C 27/081* (2013.01)

(58) Field of Classification Search
CPC ..... A43B 13/189; A43B 13/20; A43B 13/203; A43B 13/206; A43B 23/0285; A43B 23/029; A43B 17/026; A43B 17/03
See application file for complete search history.

(56) References Cited

U.S. PATENT DOCUMENTS

| | | | | |
|---|---|---|---|---|
| 7,430,817 | B2 * | 10/2008 | Abadjian | A43B 13/189 36/102 |
| 8,656,613 | B2 * | 2/2014 | Stockbridge | A43B 13/141 36/102 |
| 9,717,304 | B2 * | 8/2017 | Bernhard | B29D 35/061 |
| 11,241,063 | B2 * | 2/2022 | Auyang | A43D 11/006 |
| 2018/0064208 | A1 * | 3/2018 | Hurd | B32B 3/266 |
| 2024/0407500 | A1 * | 12/2024 | Chou | B29D 35/128 |
| 2025/0194750 | A1 * | 6/2025 | Orand | A43B 23/0285 |

* cited by examiner

*Primary Examiner* — Ted Kavanaugh
(74) *Attorney, Agent, or Firm* — Apex Juris, pllc; Cera Oh

(57) ABSTRACT

A three-dimensional curved surface air cushion module includes a first air cushion portion and a second air cushion portion pivotally connected to each other along a pivot fold line. The first air cushion portion and the second air cushion portion open, so that a first outer surface and a second outer surface tilt relatively. A first height between a first upper edge and a first lower edge is less than a wall height of the first outer surface. A second height between a second upper edge and a second lower edge is less than a wall height of the second outer surface. A curved surface air cushion product includes the three-dimensional curved surface air cushion module. The first air cushion portion and the second air cushion portion are fixed by a fixing means, so that the first curved surface and the second curved surface form a continuous curved surface.

6 Claims, 30 Drawing Sheets

THREE-DIMENSIONAL CURVED SURFACE AIR CUSHION MODULE AND CURVED SURFACE AIR CUSHION PRODUCT

BACKGROUND OF THE INVENTION

Technical Field

The present invention relates generally to a plurality of air cushion structures, and more particularly to a three-dimensional curved surface air cushion module and a curved surface air cushion product.

Description of Related Art

Existing air cushion structures are often manufactured using blow molding processes. However, such processes face numerous technical challenges when creating hollow objects with high sidewalls or curved surfaces. For example, during the production of high-sidewall hollow structures, it is difficult to control the thickness of the sidewalls during material stretching, frequently resulting in uneven sidewall thickness in the finished product. This inconsistency compromises the cushioning performance and durability of the air cushion structure.

Moreover, curved surface air cushion designs encounter stress concentration issues at the junctions between the curved surface and the sidewalls, affecting the overall structural stability. Even with specially designed molds, traditional blow molding techniques struggle to overcome the challenges of uneven thickness distribution and poor material flow when forming high sidewalls or complex curved surfaces. As a result, existing air cushion products are limited in both structural design and performance, failing to meet market demands for high-performance and highly stable air cushion products.

BRIEF SUMMARY OF THE INVENTION

In view of the above, the primary objective of the present invention is to provide a three-dimensional curved surface air cushion module and a curved surface air cushion product. The design of the three-dimensional curved surface air cushion module effectively reduces a maximum sidewall height in a mold, enhancing the yield rate of forming the curved surface air cushion product.

The present invention provides the three-dimensional curved surface air cushion module including a first air cushion portion and a second air cushion portion. The first air cushion portion is pivotally connected to the second air cushion portion. The first air cushion portion has a first outer surface, a first curved surface, and a first connecting surface, wherein the first outer surface has a first upper edge and a first lower edge respectively located on two ends of the first outer surface. The first curved surface is connected to the first upper edge of the first outer surface, and the first connecting surface is connected to the first lower edge of the first outer surface. The second air cushion portion has a second outer surface, a second curved surface, and a second connecting surface. The second outer surface has a second upper edge and a second lower edge respectively located on two ends of the second outer surface. The second curved surface corresponds to the contour and position of the first curved surface. The second curved surface is connected to the second upper edge of the second outer surface. The second connecting surface is connected to the second lower edge of the second outer surface. The second connecting surface is connected to the first connecting surface. A pivot fold line is defined, corresponding to a junction between the first connecting surface and the second connecting surface. The first air cushion portion and the second air cushion portion are pivoted along the pivot fold line, so that the first air cushion portion and the second air cushion portion open relative to each other. The first outer surface and the second outer surface tilt relative to each other. A first height is defined between the first upper edge and the first lower edge, wherein the first height is less than a wall height of the first outer surface. A second height is defined between the second upper edge and the second lower edge, wherein the second height is less than a wall height of the second outer surface.

The present invention further provides a curved surface air cushion product including a three-dimensional curved surface air cushion module. The three-dimensional curved surface air cushion module comprising a first air cushion portion and a second air cushion portion, wherein the first air cushion portion is pivotally connected to the second air cushion portion. The first air cushion portion and the second air cushion portion are independently filled with fluid. The first air cushion portion has a first outer surface, a first curved surface, and a first connecting surface. The first curved surface and the first connecting surface are connected to two ends of the first outer surface, respectively. The second air cushion portion has a second outer surface, a second curved surface, and a second connecting surface. The second curved surface and the second connecting surface are connected to two ends of the second outer surface, respectively. The second curved surface corresponds to the contour of the first curved surface. The second connecting surface is connected to the first connecting surface. A pivot fold line is defined, corresponding to a junction between the first connecting surface and the second connecting surface. The first air cushion portion and the second air cushion portion are symmetrically disposed with the pivot fold line as the center. The first air cushion portion and the second air cushion portion are fixed by a fixing means, so that the first curved surface of the first air cushion portion and the second curved surface of the second air cushion portion face each other. The first curved surface and the second curved surface are located adjacent to each other to form a continuous curved surface.

The present invention further provides a curved surface air cushion product including a three-dimensional curved surface air cushion module. The three-dimensional curved surface air cushion module comprising a first air cushion portion and a second air cushion portion, wherein the first air cushion portion and the second air cushion portion are independently filled with fluid. The first air cushion portion has a first curved surface, and the second air cushion portion has a second curved surface. The second curved surface corresponds to the contour of the first curved surface. The first air cushion portion and the second air cushion portion are fixed by a fixing means, so that the first curved surface of the first air cushion portion and the second curved surface of the second air cushion portion face each other. The first curved surface and the second curved surface are located adjacent to each other to form a continuous curved surface.

The effects of the present invention are as follows, the first air cushion portion and the second air cushion portion could pivot along the pivot fold line, allowing the three-dimensional curved surface air cushion module to be more flexible during the filling process. When the three-dimensional curved surface air cushion module is placed into an air cushion molding mold for filling, the first air cushion portion and the second air cushion portion are pivoted along the pivot fold line, so that the first air cushion portion and the second air cushion portion open relative to each other. In this way, the first outer surface of the first air cushion portion and the second outer surface of the second air cushion portion tilt relative to each other, thereby reducing a maximum sidewall height of the first air cushion portion and a maximum sidewall height of the second air cushion portion in the air cushion molding mold. The design helps stabilize the thickness distribution at a plurality of junctions between the first outer surface and the first curved surface, as well as between the second outer surface and the second curved surface, ultimately improving the molding yield of the three-dimensional curved surface air cushion module.

Additionally, the curved surface air cushion product has the continuous curved surface, which enhances the elastic support force of a medial arch and an inner side of a foot. The three-dimensional curved surface air cushion module could be fixed using an adhesive or a frame body, thereby enhancing the structural stability of the curved surface air cushion product. Additionally, the curved surface air cushion product could adjust the filling pressure of the first air cushion portion and the second air cushion portion based on the gait differences of a wearer. For example, the curved surface air cushion product could adjust the filling pressure of the first air cushion portion to be greater than that of the second air cushion portion, based on the foot pressure of the wearer with pronation, thereby helping to support the pressure from pronated foot of the wearer. Alternatively, the curved surface air cushion product could also adjust the filling pressure of the second air cushion portion to be greater than that of the first air cushion portion, based on the foot pressure of the wearer with supination, thereby enhancing walking comfort and safety for the wearer.

BRIEF DESCRIPTION OF THE SEVERAL VIEWS OF THE DRAWINGS

The present invention would be best understood by referring to the following detailed description of some illustrative embodiments in conjunction with the accompanying drawings, in which.

DETAILED DESCRIPTION OF THE INVENTION

Figure 1:
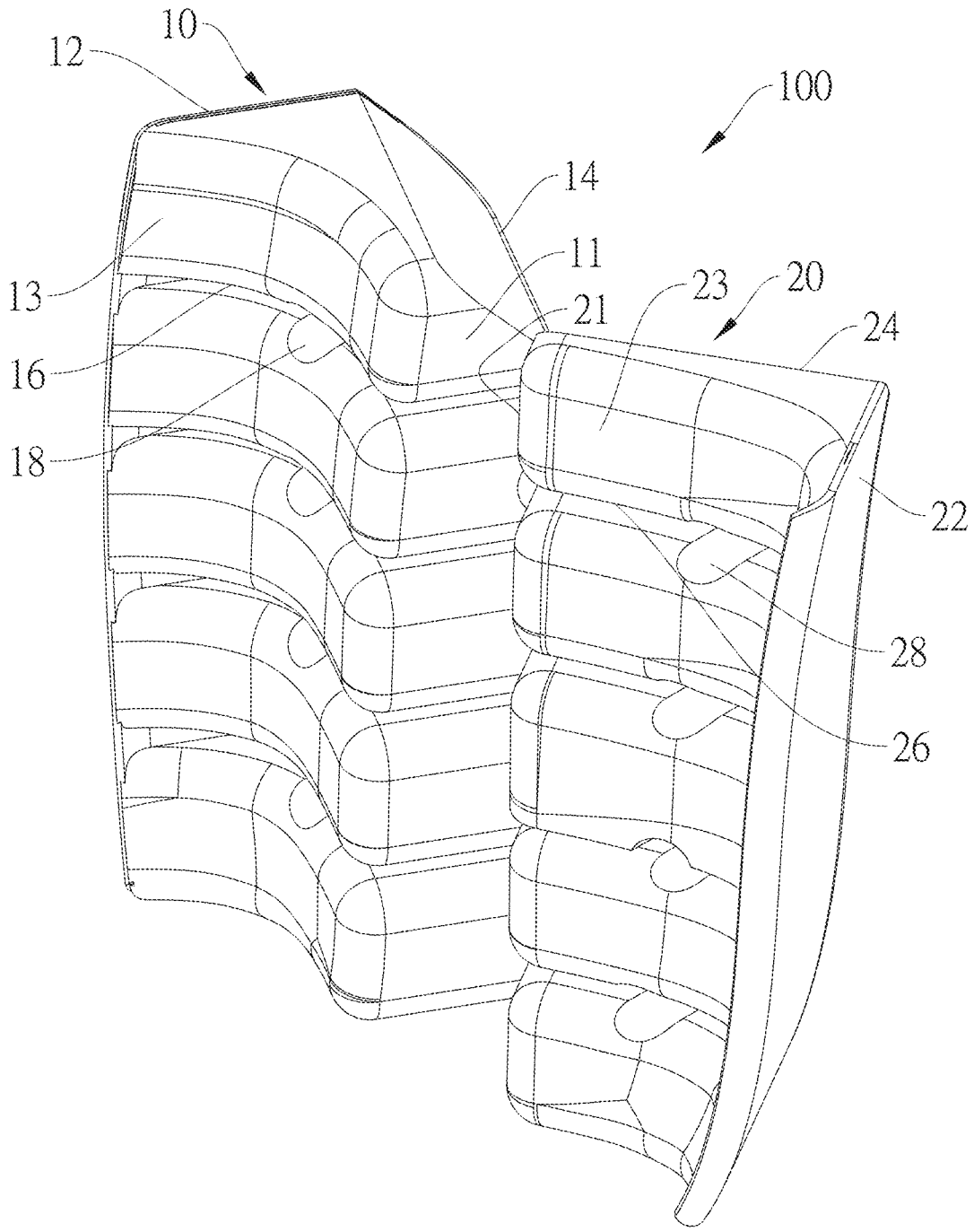
FIG. 1 is a perspective view of the three-dimensional curved surface air cushion module according to a first embodiment of the present invention.
Figure 2:
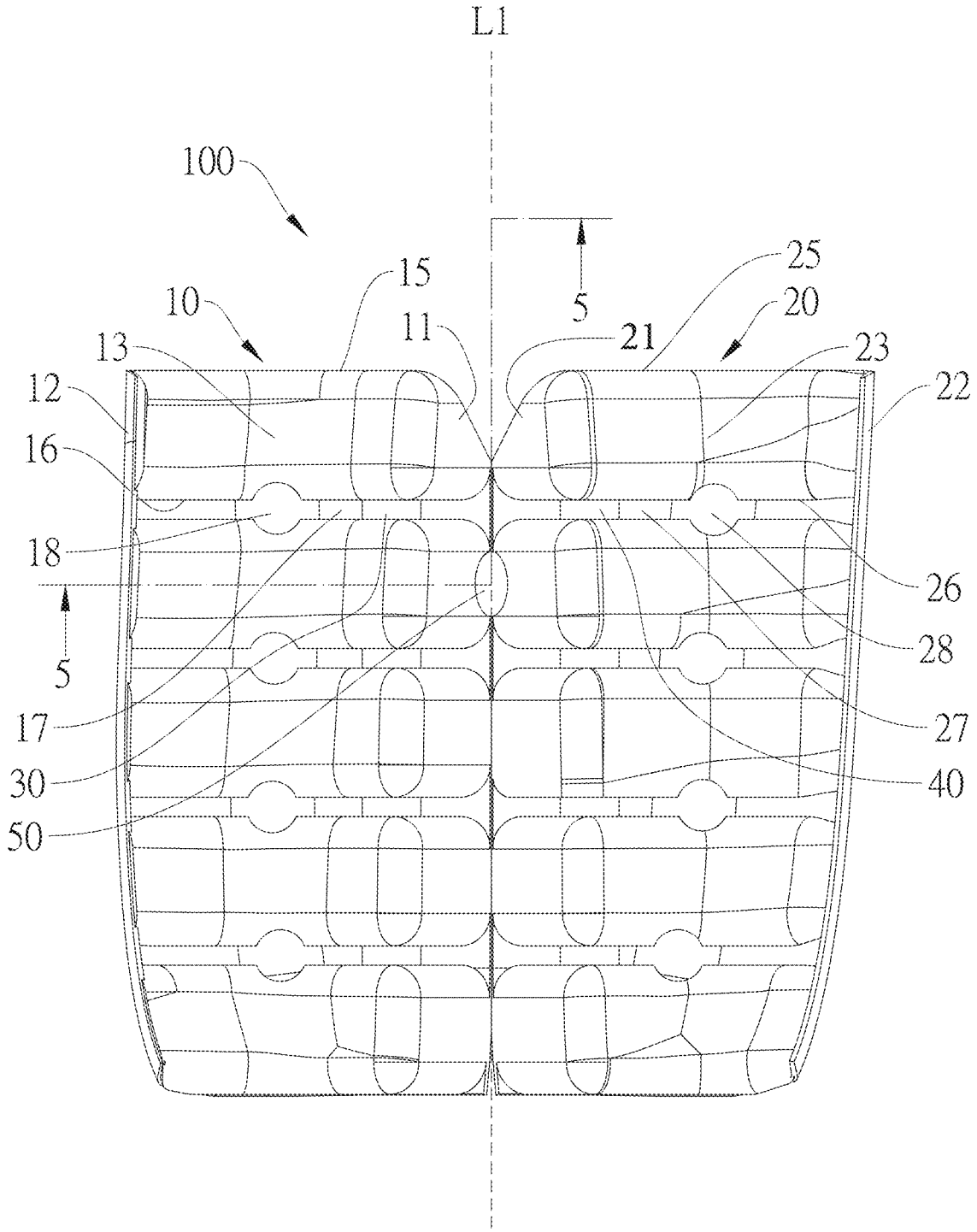
FIG. 2 is a front view of the three-dimensional curved surface air cushion module according to the first embodiment of the present invention.

A three-dimensional curved surface air cushion module 100 according to a first embodiment of the present invention is illustrated in FIG. 1 and FIG. 2. The three-dimensional curved surface air cushion module 100 includes a plurality of first air cushion portions 10 and a plurality of second air cushion portions 20. The first air cushion portions 10 are pivotally connected to the second air cushion portions 20. In the current embodiment, the first air cushion portions 10 and the second air cushion portions 20 are three-dimensional hollow structures. A pivot fold line L1 is defined at a pivot connection located between the first air cushion portions 10 and the second air cushion portions 20. The three-dimensional curved surface air cushion module 100 is in a semi-finished state which is not yet filled with fluid, wherein the fluid might be either a gas or a liquid.

Figure 3:
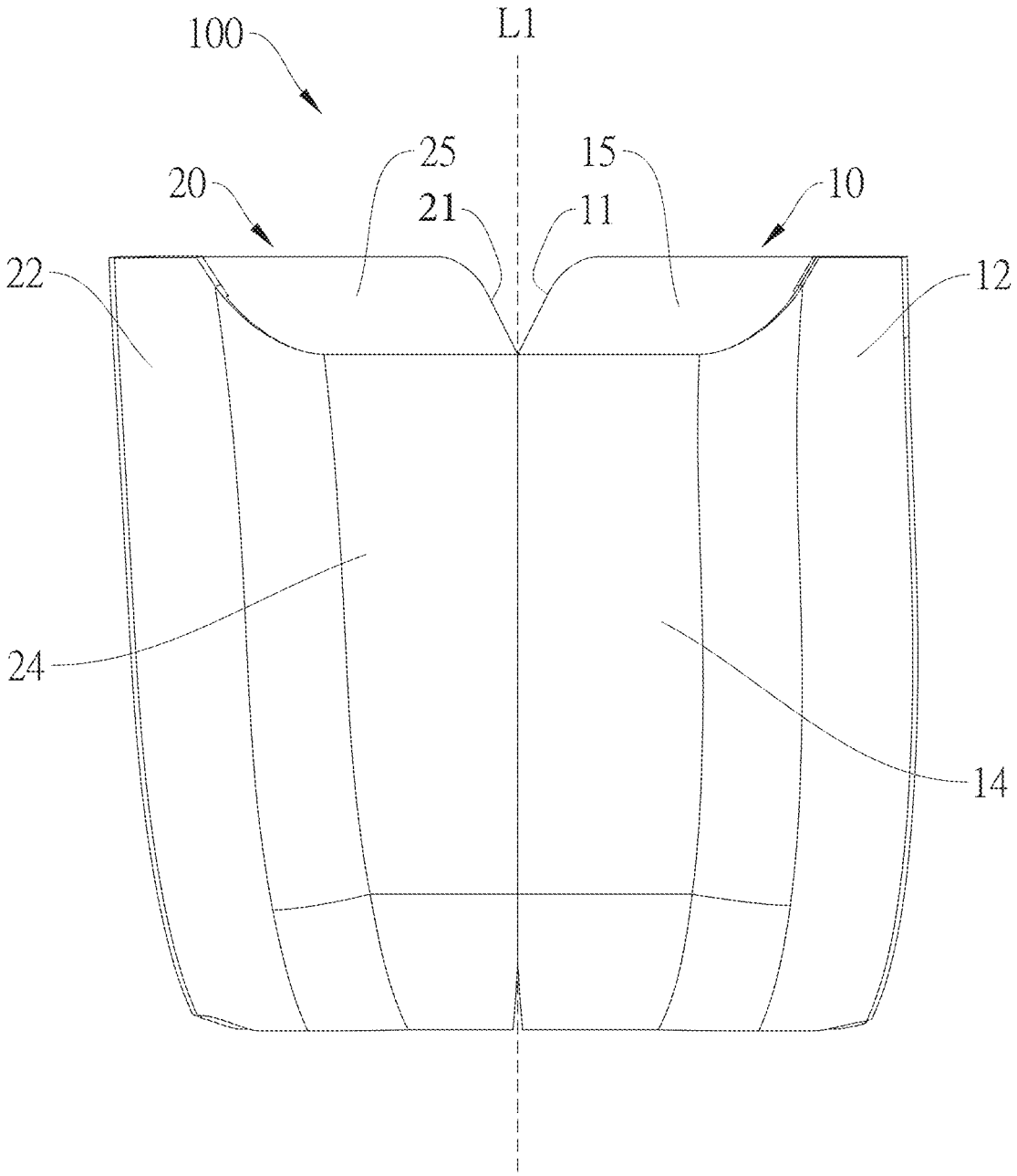
FIG. 3 is a rear view of the three-dimensional curved surface air cushion module according to the first embodiment of the present invention.
Figure 4:
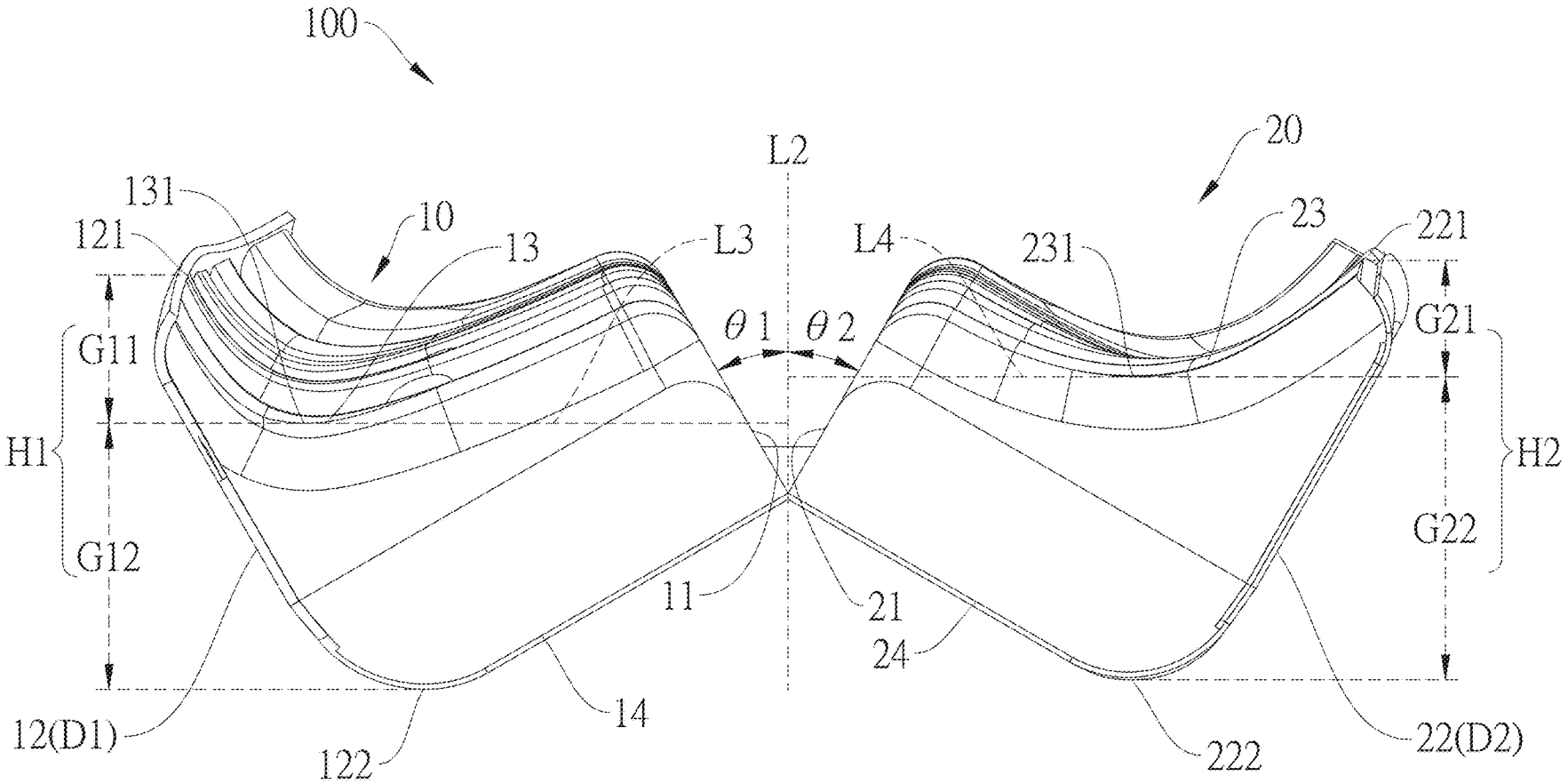
FIG. 4 is a top view of the three-dimensional curved surface air cushion module according to the first embodiment of the present invention.
Figure 5:
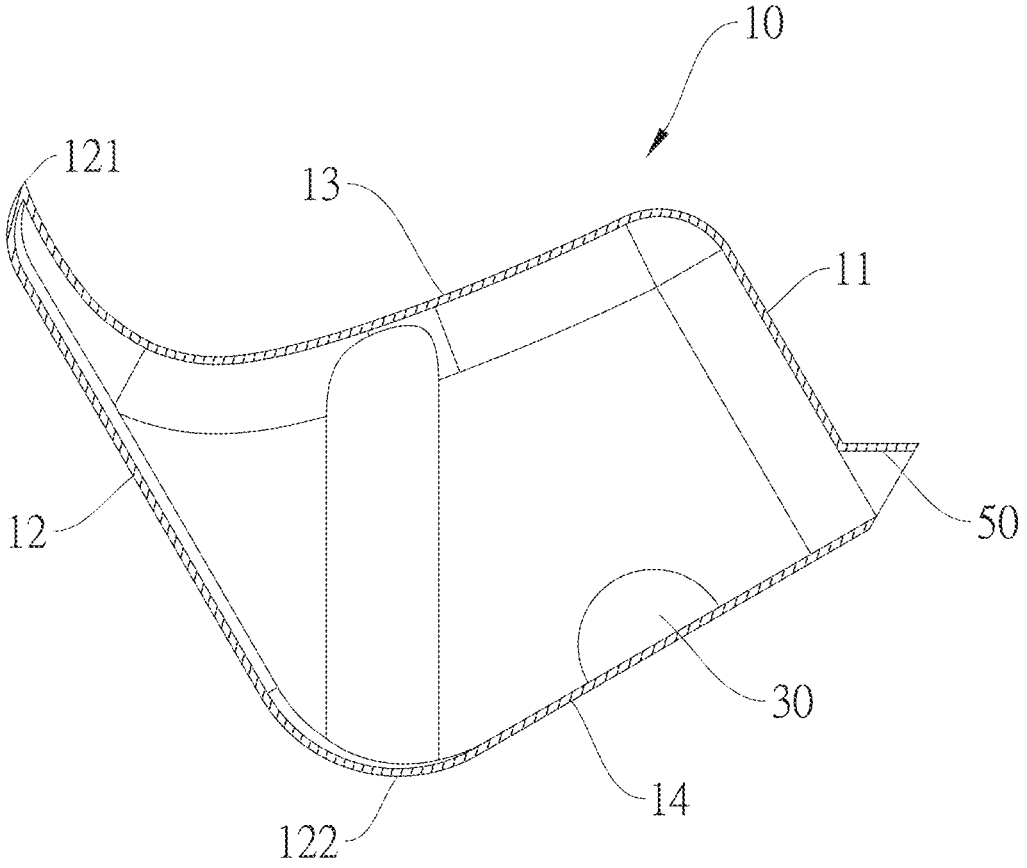
FIG. 5 is a sectional view along the 5-5 line in FIG. 2.

The first air cushion portions 10 are arranged in parallel along the pivot fold line L1 and are connected to each other. As shown in FIG. 2 to FIG. 4, each first air cushion portion 10 has a first inner surface 11, a first outer surface 12, a first curved surface 13, a first connecting surface 14, a first front surface 15, and a first rear surface 16. Each first inner surface 11 and each first outer surface 12 are located on two opposite sides of each first air cushion portion 10. Each first outer surface 12 has a first upper edge 121 and a first lower edge 122, which are respectively located on two ends of each first outer surface 12. Each first curved surface 13 extends upward in an arc from each first inner surface 11 to each first outer surface 12 and is connected to each first upper edge 121. Each first connecting surface 14 is connected in a straight line, relative to each first curved surface 13, to the first lower edge 122 of each first outer surface 12 and each first inner surface 11. Each first front surface 15 and each first rear surface 16 are arranged along a direction of the pivot fold line L1 and connect to each first inner surface 11, each first outer surface 12, each first curved surface 13, and each first connecting surface 14. The first connecting surfaces 14 are coplanar with the first outer surfaces 12.

The second air cushion portions 20 are arranged in parallel along the pivot fold line L1 and are connected to each other. The structure of the second air cushion portions 20 are basically similar to the structure of the first air cushion portions 10. As shown in FIG. 2 and FIG. 3, each second air cushion portion 20 has a second inner surface 21, a second outer surface 22, a second curved surface 23, a second connecting surface 24, a second front surface 25, and a second rear surface 26. Each second inner surface 21 and each second outer surface 22 are located on two opposite sides of each second air cushion portion 20. Each first inner surface 11 and each second inner surface 21 face each other. Each second outer surface 22 has a second upper edge 221 and a second lower edge 222, which are respectively located on two ends of each second outer surface 22. Each second curved surface 23 corresponds to the contour and position of each first curved surface 13. Each second curved surface 23 extends upward in an arc from each second inner surface 21 to each second outer surface 22 and is connected to each second upper edge 221. Each second connecting surface 24 is connected in a straight line, relative to each second curved surface 23, to the second lower edge 222 of each second outer surface 22 and each second inner surface 21. Each second connecting surface 24 is connected to each first connecting surface 14. Each second front surface 25 and each second rear surface 26 are arranged along the direction of the pivot fold line L1 and connect to each second inner surface 21, each second outer surface 22, each second curved surface 23, and each second connecting surface 24. The pivot fold line L1 corresponds to a junction between each first connecting surface 14 and each second connecting surface 24. The second connecting surfaces 24 are coplanar with the second outer surfaces 23.

As shown in FIG. 2, in the current embodiment, the three-dimensional curved surface air cushion module 100 includes a plurality of first axial communication portions 30, a plurality of second axial communication portions 40, and a lateral communication portion 50.

Each first axial communication portion 30 is disposed between every two adjacent first air cushion portions 10. As shown in FIG. 2, a first gap 17 is provided between every two adjacent first air cushion portions 10. Each first axial communication portion 30 is disposed in the corresponding first gap 17 and is connected to each first connecting surface 14. This arrangement allows two ends of each first axial communication portion 30 to communicate with the first front surface 15 of one of the first air cushion portions 10 and the first rear surface 16 of an adjacent first air cushion portion 10. A first clamping groove 18 is provided between every two adjacent first air cushion portions 10. Each first clamping groove 18 is recessed from each first curved surface 13 toward each first connecting surface 14 within the corresponding first gap 17. Each first clamping groove 18 is disposed between the first front surface 15 of one of the first air cushion portions 10 and the first rear surface 16 of the adjacent first air cushion portion 10.

The second axial communication portions 40 are respectively disposed between every two adjacent second air cushion portion 20. As shown in FIG. 2, similarly, a second gap 27 is provided between every two adjacent second air cushion portion 20. Each second axial communication portion 40 is disposed in the corresponding second gap 27 and is connected to each second connecting surface 24. This arrangement allows two ends of each second axial communication portion 40 to communicate with the second front surface 25 of one of the second air cushion portions 20 and the second rear surface 26 of an adjacent second air cushion portion 20. A second clamping groove 28 is provided between every two adjacent second air cushion portion 20. Each second clamping groove 28 is recessed from each second curved surface 23 toward each second connecting surface 24 within the corresponding second gap 27. Each second clamping groove 28 is disposed between the second front surface 25 of one of the second air cushion portions 20 and the second rear surface 26 of the adjacent second air cushion portion 20.

As shown in FIG. 2, the lateral communication portion 50 is an elastic telescopic tube. The lateral communication portion 50 is disposed between the first inner surface 11 of one of the first air cushion portions 10 and the second inner surface 21 of an adjacent second air cushion portion 20, enabling the first air cushion portions 10 and the second air cushion portions 20 to communicate with each other through the lateral communication portion 50.

In other embodiments, the structure and arrangement of the three-dimensional curved surface air cushion module 100 could be adjusted as needed. For example, the first gap 17 between each pair of adjacent first air cushion portions 10 could be omitted by directly adhering the adjacent first air cushion portions 10, thereby simultaneously omitting the first clamping grooves 18. The second gap 27 between each pair of adjacent second air cushion portions 20 could be omitted by directly adhering the adjacent second air cushion portions 20, thereby simultaneously omitting the second clamping grooves 28. The first axial communication portions 30, the second axial communication portions 40, and the lateral communication portion 50 could be omitted, provided that each first air cushion portion 10 and each second air cushion portion 20 could independently be filled with fluid. It is not required for adjacent first air cushion portions 10 or adjacent second air cushion portions 20 to communicate with one another. The number of the first air cushion portion 10 and the number of the second air cushion portion 20 could each be at least one. The number of the lateral communication portion 50 could be more than one, enabling communication between each first air cushion portion 10 and each second air cushion portion 20.

As shown in FIG. 2 to FIG. 5, a central axis L2 is defined between the first inner surface 11 of each first air cushion portion 10 and the second inner surface 21 of each second air cushion portion 20, passing through the pivot fold line L1. Each first air cushion portion 10 and each second air cushion portion 20 are pivotally opened along the pivot fold line L1, so that each first outer surface 12 and each second outer surface 22 tilt relative to each other. At this time, a first angle θ1 is provided between each first inner surface 11 and each central axis L2, and a second angle θ2 is provided between each second inner surface 21 and each central axis L2. The first angle θ1 and the second angle θ2 are each greater than or equal to 10 degrees and less than or equal to 45 degrees. Furthermore, a longitudinal direction of the first clamping groove 18 of each first air cushion portion 10 and a longitudinal direction of the second clamping groove 28 of each second air cushion portion 20 are both parallel to each central axis L2.

Moreover, in the current embodiment, when the three-dimensional curved surface air cushion module 100 is pivotally opened along the pivot fold line L1, a first height H1 is defined between each first upper edge 121 and each first lower edge 122, wherein each first height H1 is less than a wall height D1 of each first outer surface 12. A second height H2 is defined between each second upper edge 221 and each second lower edge 222, the second height H2 is less than a wall height D2 of each second outer surface 22. The first height H1 is a vertical distance between the first upper edge 121 and the first lower edge 122 of each first outer surface 12 when in a tilted state. The wall height D1 of each first outer surface 12, on the other hand, is a vertical distance between the first upper edge 121 and the first lower edge 122 along the first outer surface 12 when in a non-tilted state. The second height H2 is a vertical distance between the second upper edge 221 and the second lower edge 222 of each second outer surface 22 when in a tilted state. The wall height D2 of each second outer surface 22, on the other hand, is a vertical distance between the second upper edge 221 and the second lower edge 222 along the second outer surface 22 when in a non-tilted state.

Specifically, as shown in FIG. 4, a single first air cushion portion 10 and a single second air cushion portion 20 are used as examples. The first curved surface 13 of the first air cushion portion 10 has a first valley reference point 131. The first valley reference point 131 is a center of a concave valley of the first curved surface 13. A first reference line L3 is defined, tangent to the first valley reference point 131 of the first curved surface 13. The first reference line L3 passes through the first outer surface 12 and is perpendicular to the central axis L2. The first upper edge 121 and the first lower edge 122 of the first outer surface 12 are located on two sides of the first reference line L3. The first air cushion portion 10 has a first upper edge distance G11, which is a distance between the first reference line L3 and the first upper edge 121. The first air cushion portion 10 has a first lower edge distance G12, which is a distance between the first reference line L3 and the first lower edge 122. The first upper edge distance G11 is less than the first lower edge distance G12, and a combination of the first upper edge distance G11 and the first lower edge distance G12 defines the first height H1. Similarly, the second curved surface 23 of the second air cushion portion 20 has a second valley reference point 231. The second valley reference point 231 is a center of a concave valley of the second curved surface 23. A second reference line L4 is defined, tangent to the second valley reference point 231 of the second curved surface 23. The second reference line L4 passes through the second outer surface 22 and is perpendicular to the central axis L2. The second upper edge 221 and the second lower edge 222 of the second outer surface 22 locate on two sides of the second reference line L4. The second air cushion portion 20 has a second upper edge distance G21, which is a distance between the second reference line L4 and the second upper edge 221. The second air cushion portion 20 has a second lower edge distance G22, which is a distance between the second reference line L4 and the second lower edge 222. The second upper edge distance G21 is less than the second lower edge distance G22, and a combination of the second upper edge distance G21 and the second lower edge distance G22 defines the second height H2.

Thus, the first air cushion portions 10 and the second air cushion portions 20 could pivot along the pivot fold line L1, allowing the three-dimensional curved surface air cushion module 100 to be more flexible during the filling process. When the three-dimensional curved surface air cushion module 100 is placed into an air cushion molding mold (not shown) for filling, the first air cushion portions 10 and the second air cushion portions 20 are pivoted along the pivot fold line L1, so that the first air cushion portions 10 and the second air cushion portions 20 open relative to each other. In this way, the first outer surface 12 of each first air cushion portion 10 and the second outer surface 22 of each second air cushion portion 20 tilt relative to each other, thereby reducing a maximum sidewall height of each first air cushion portion 10 and a maximum sidewall height of each second air cushion portion 20 in the air cushion molding mold. The design helps stabilize the thickness distribution at a plurality of junctions between each first outer surface 12 and each first curved surface 13, as well as between each second outer surface 22 and each second curved surface 23, minimizing defects at a plurality of bends of each first air cushion portion 10 and each second air cushion portion 20 during the filling and molding process, ultimately improving the molding yield of the three-dimensional curved surface air cushion module 100.

Figure 6:
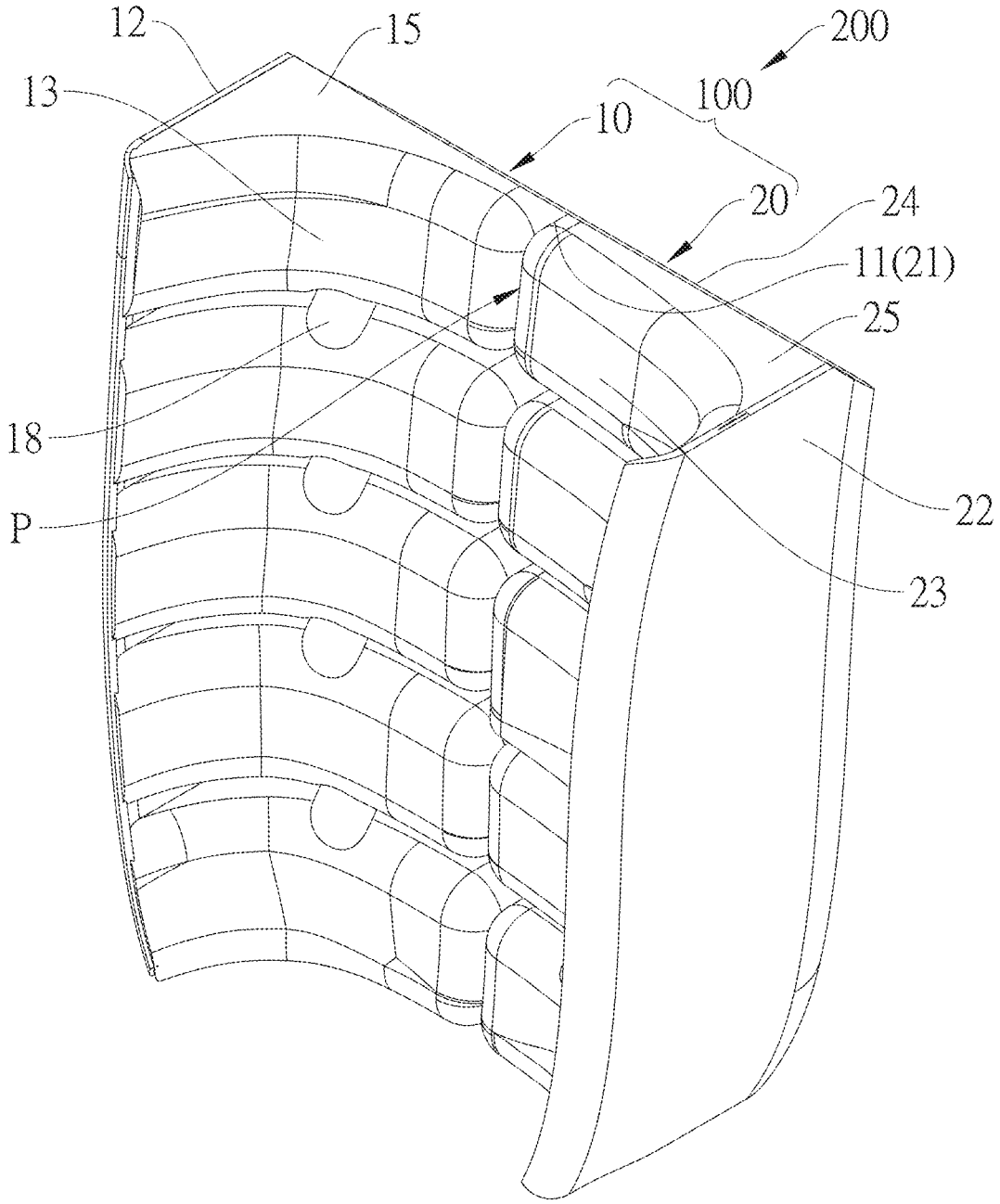
FIG. 6 is a perspective view of the curved surface air cushion product, which includes the three-dimensional curved surface air cushion module in the first embodiment, according to a second embodiment of the present invention.
Figure 7:
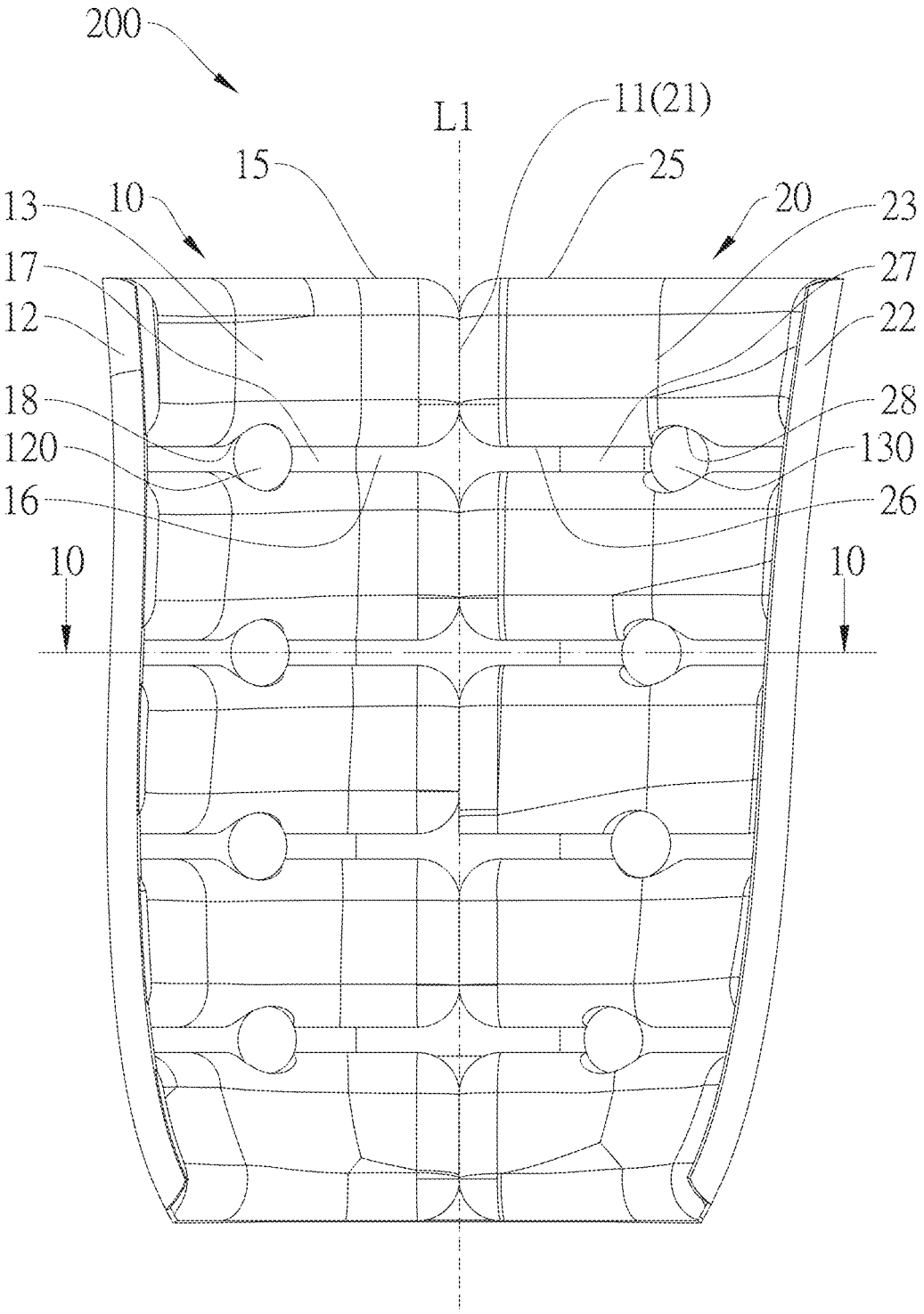
FIG. 7 is a front view of the curved surface air cushion product according to the second embodiment of the present invention.
Figure 8:
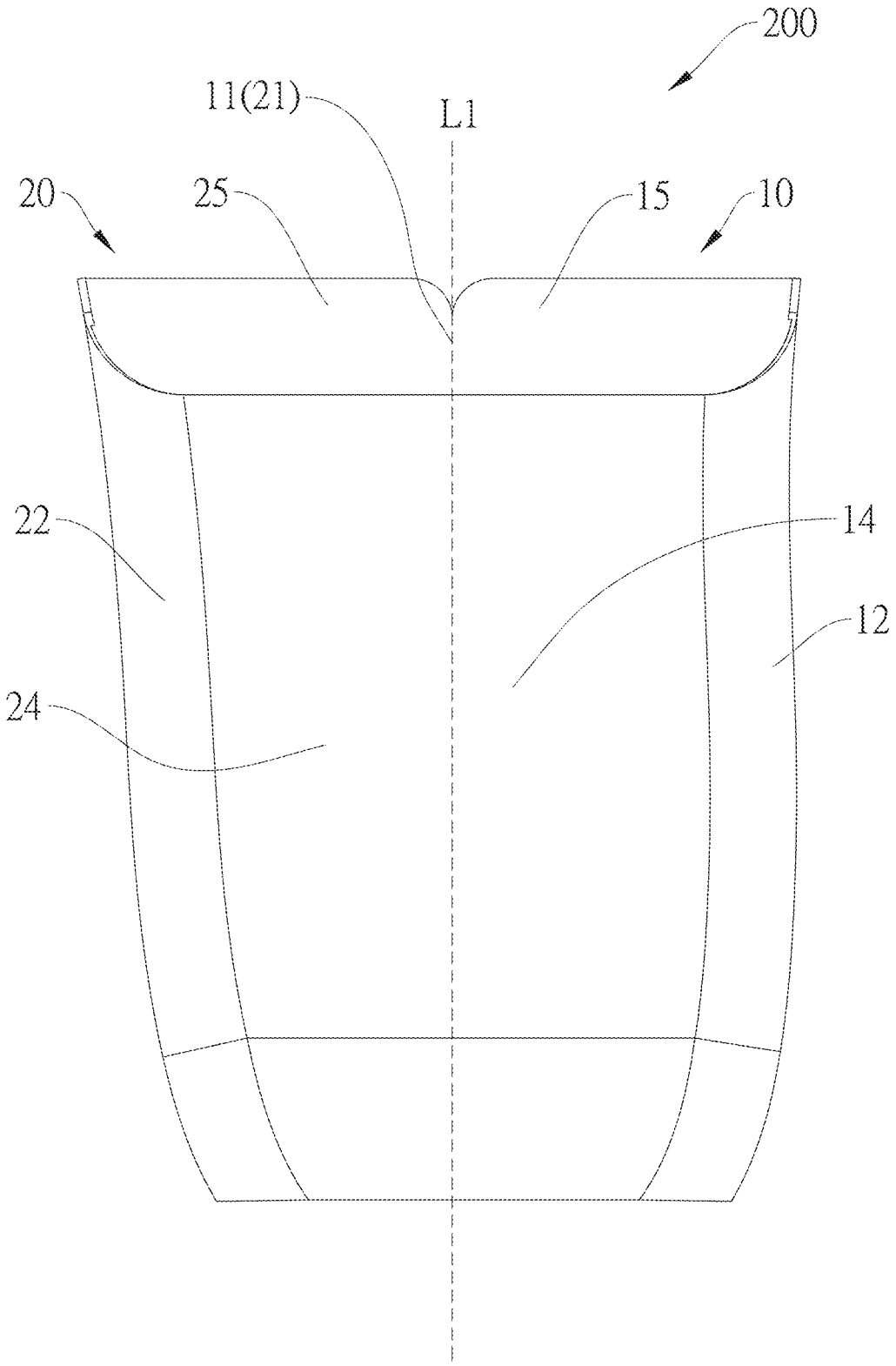
FIG. 8 is a rear view of the curved surface air cushion product according to the second embodiment of the present invention.

A curved surface air cushion product 200 according to a second embodiment of the present invention is illustrated in FIG. 6 and FIG. 7. The curved surface air cushion product 200 includes the three-dimensional curved surface air cushion module 100 of the first embodiment. The curved surface air cushion product 200 is basically formed by filling and molding the three-dimensional curved surface air cushion module 100. The curved surface air cushion product 200 is described as an example of a heel air cushion for a shoe sole, but is not limited thereto. In other embodiments, the curved surface air cushion product 200 could also have an overall shape of the shoe sole. The three-dimensional curved surface air cushion module 100 includes the first air cushion portions 10, the second air cushion portions 20, the first axial communication portions 30, the second axial communication portion 40, and the lateral communication portion 50 (not shown). In the second embodiment, each first air cushion portion 10 and each second air cushion portion 20 are filled with fluid.

As shown in FIG. 7 to FIG. 10, in the current embodiment, each first air cushion portion 10 and each second air cushion portion 20 are symmetrically disposed with the pivot fold line L1 as the center. Each first air cushion portion 10 and each second air cushion portion 20 are fixed by a fixing means to obtain the curved surface air cushion product 200. At this time, each second inner surface 21 and each first inner surface 11 face each other. A gap P is provided between the first inner surfaces 11 and the second inner surfaces 21. Each central axis L2 is located between each first inner surface 11 and each second inner surface 21 and passes through the gap P. In this way, the first curved surface 13 of each first air cushion portion 10 and the second curved surface 23 of each second air cushion portion 20 face each other. The first curved surfaces 13 and the second curved surfaces 23 are located adjacent to each other to form a continuous curved surface 110. When the curved surface air cushion product 200 is used in combination with a shoe body, the continuous curved surface 110 enhances the elastic support force for a medial arch and an inner side of a foot, improving the walking comfort for a wearer. Additionally, the continuous curved surface 110 could accommodate a shoe insole or a rigid curved panel (not shown), wherein the rigid curved panel corresponds to a surface contour of the continuous curved surface 110, further providing the wearer with a more lightweight and effortless walking experience.

Figure 9:
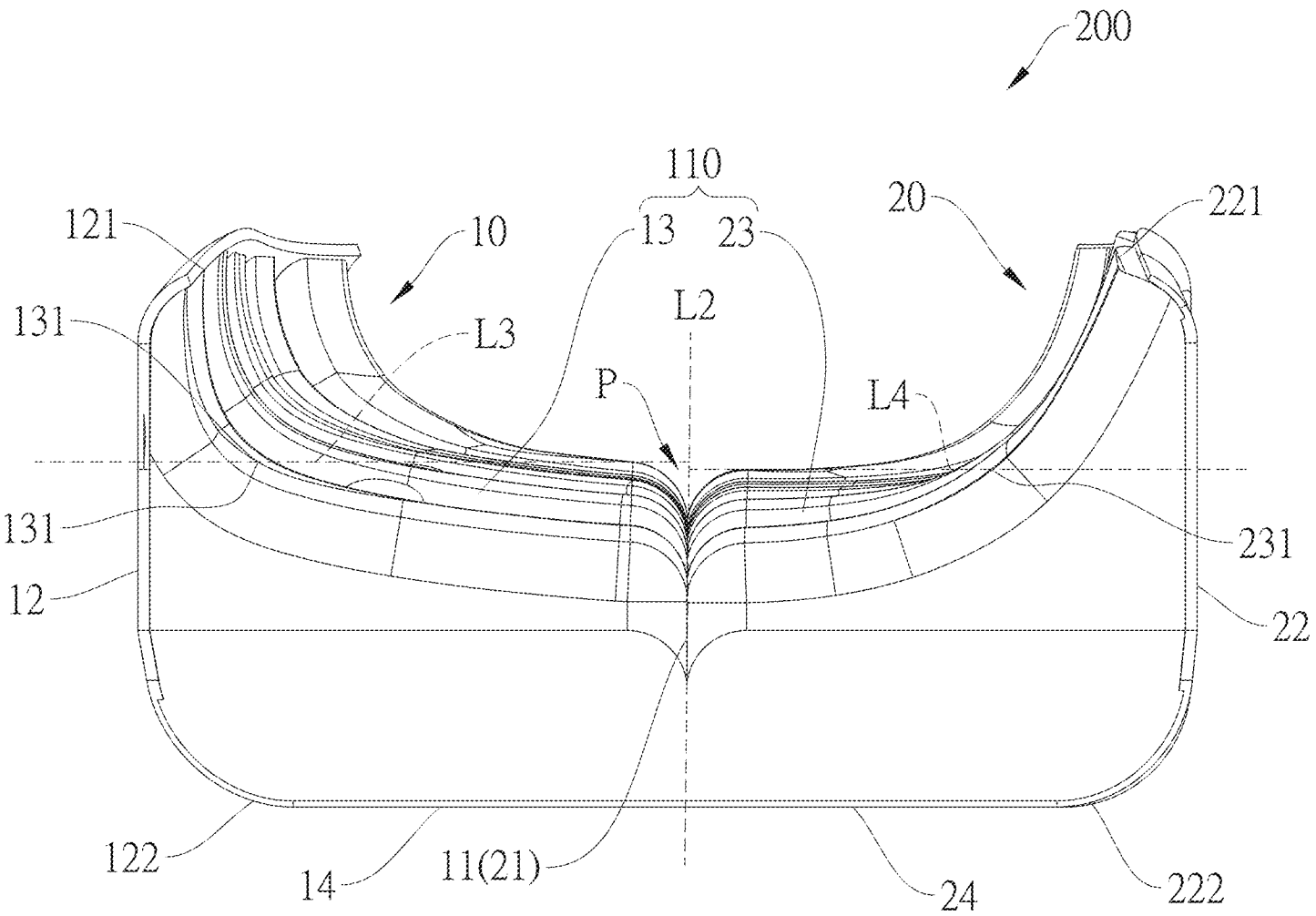
FIG. 9 is a top view of the curved surface air cushion product according to the second embodiment of the present invention.

Specifically, as shown in FIG. 9, when each first air cushion portion 10 and each second air cushion portion 20 are aligned side by side, the first reference line L3 of each first air cushion portion 10 passes through the first valley reference point 131 of each first curved surface 13 and is perpendicular to each central axis L2. The first upper edge 121 and the first lower edge 122 of each first outer surface 12 are located on two sides of the first reference line L3. The second reference line L4 of each second air cushion portion 20 passes through the second valley reference point 231 of each second curved surface 23 and is perpendicular to each central axis L2. The second upper edge 221 and the second lower edge 222 of each second outer surface 22 are located on two sides of each second reference line L4. This indicates that a junction between the first curved surface 13 of each first air cushion portion 10 and the first upper edge 121 of each first outer surface 12 is positioned above each first reference line L3, and a junction between the second curved surface 23 of each second air cushion portion 20 and the second upper edge 221 of each second outer surface 22 is positioned above each second reference line L4. Furthermore, in the continuous curved surface 110, each first curved surface 13 and each second curved surface 23 extend upward in an arc shape from each first inner surface 11 and each second inner surface 21 toward each first outer surface 12 and each second outer surface 22, respectively.

Figure 10:
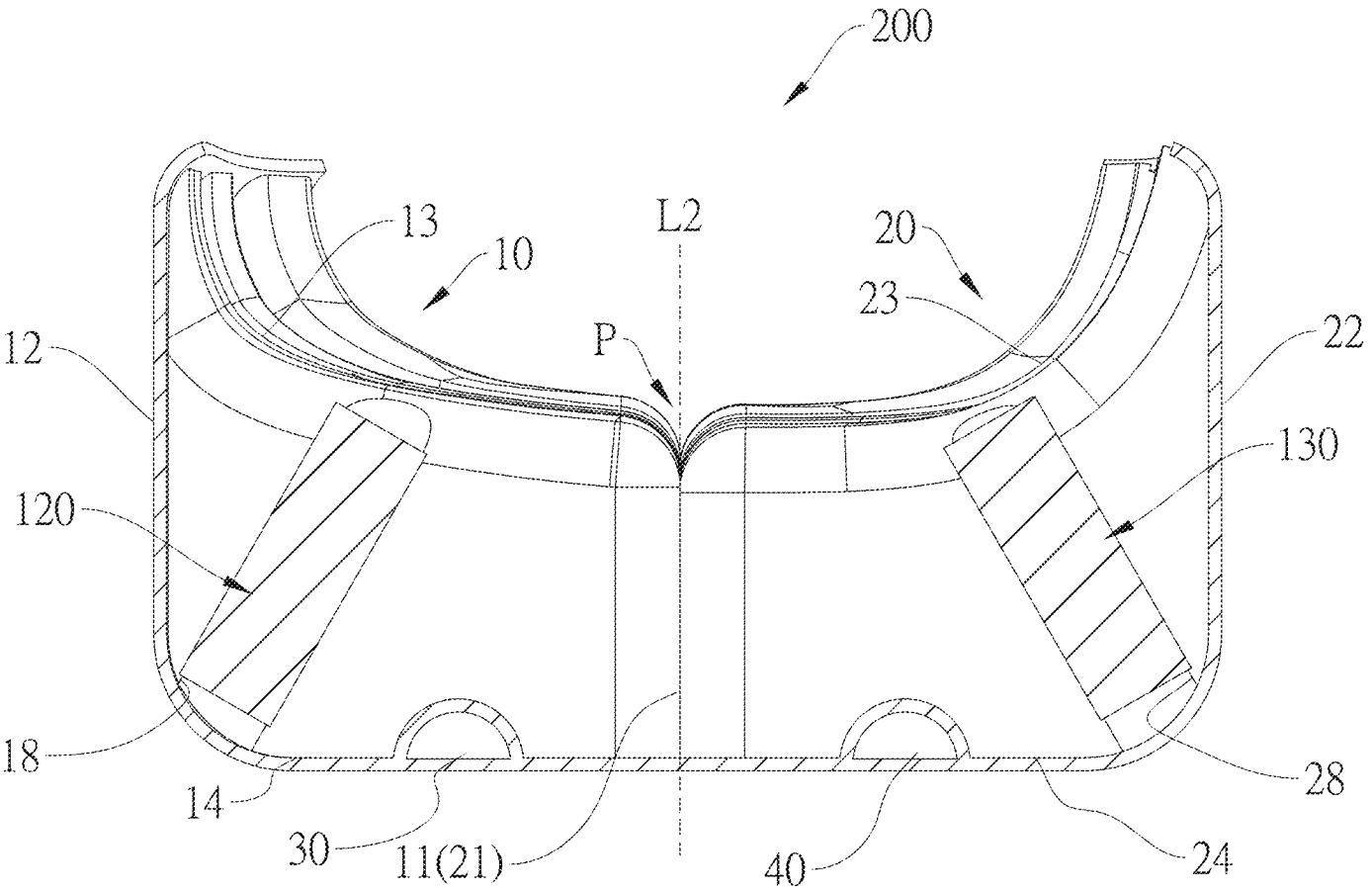
FIG. 10 is a sectional view along the 10-10 line in FIG. 7.

In the current embodiment, the fixing means for aligning each first air cushion portion 10 with each second air cushion portion 20 side by side is an adhesive (not shown), which is applied within the gap P. The adhesive fixes the first inner surface 11 of each first air cushion portion 10 to the second inner surface 21 of each second air cushion portion 20, thereby combining each first air cushion portion 10 with each second air cushion portion 20 side by side. Additionally, as shown in FIG. 7 and FIG. 10, the curved surface air cushion product 200 could be configured based on the foot pressure distribution of the wearer. A first support column 120 could be inserted into any first clamping groove 18 between two adjacent first air cushion portions 10, and a second support column 130 could be inserted into any second clamping groove 28 between two adjacent second air cushion portions 20. The first support column 120 and the second support column 130 are provided to enhance the gait comfort of the wearer when using the curved surface air cushion product 200. Furthermore, the first support column 120 and the second support column 130 are respectively tilted toward the central axis L2.

Figure 11:
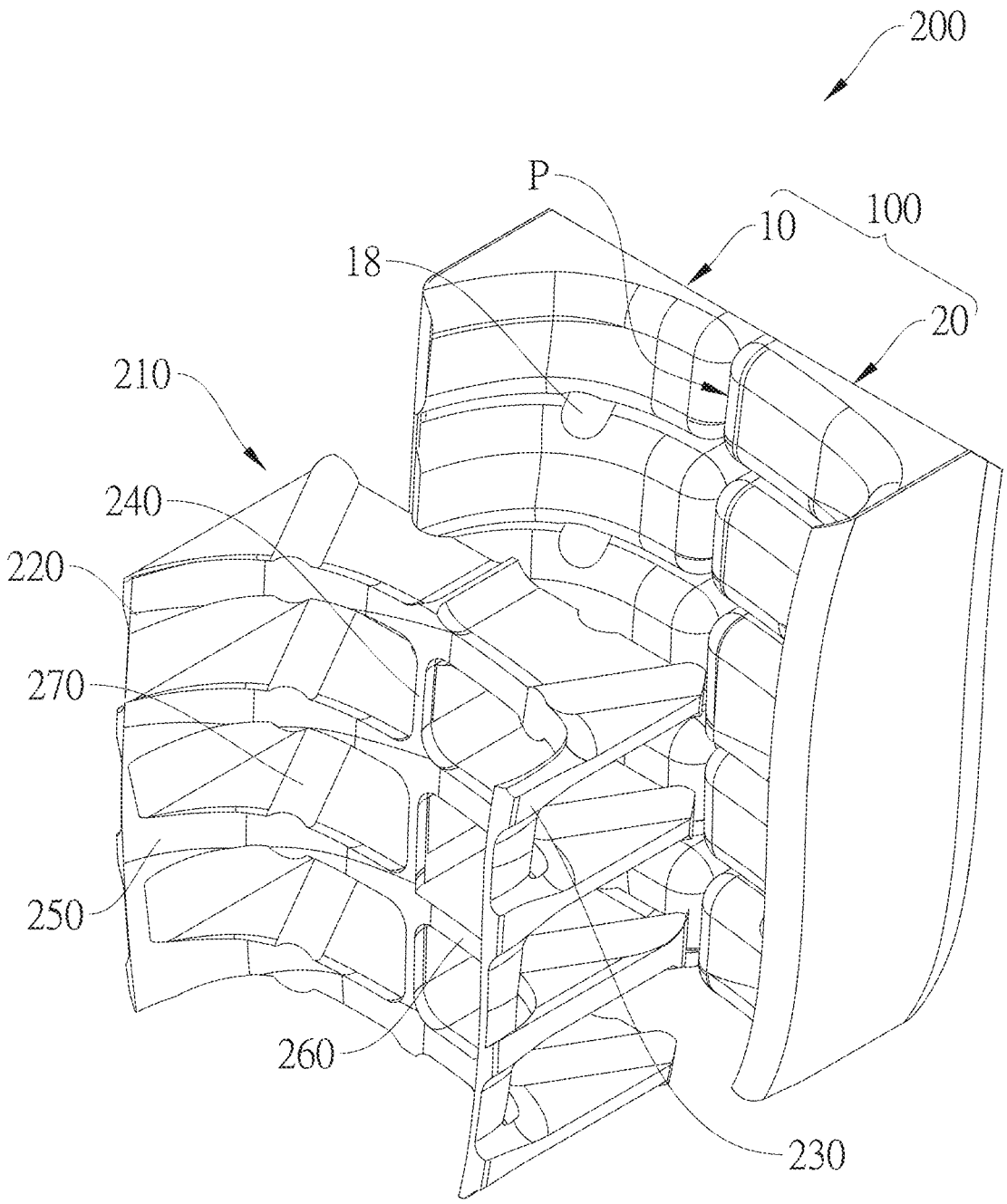
FIG. 11 is a perspective view of the curved surface air cushion product, paired with the frame body, according to the second embodiment of the present invention.
Figure 12:
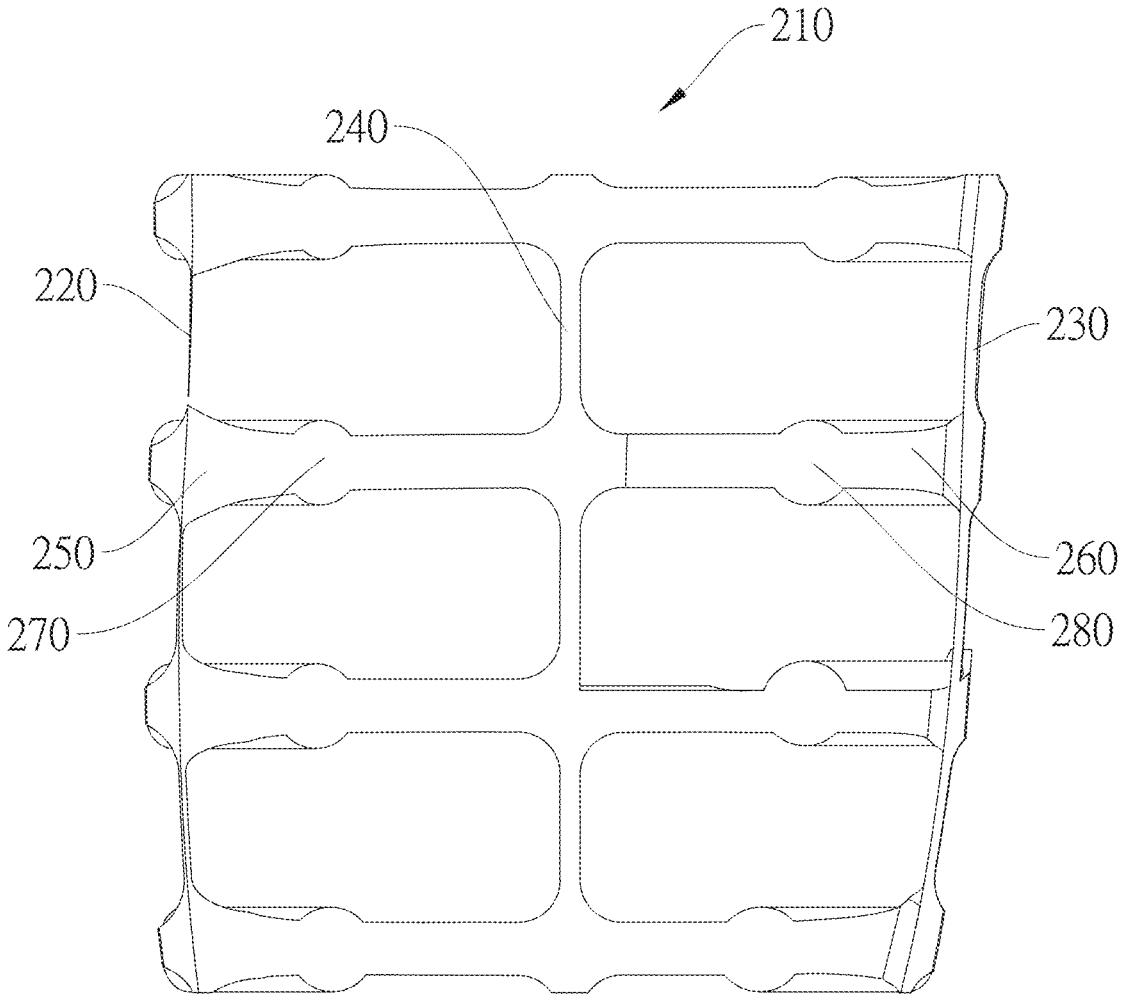
FIG. 12 is a front view of the frame body of the curved surface air cushion product according to the second embodiment of the present invention.
Figure 13:
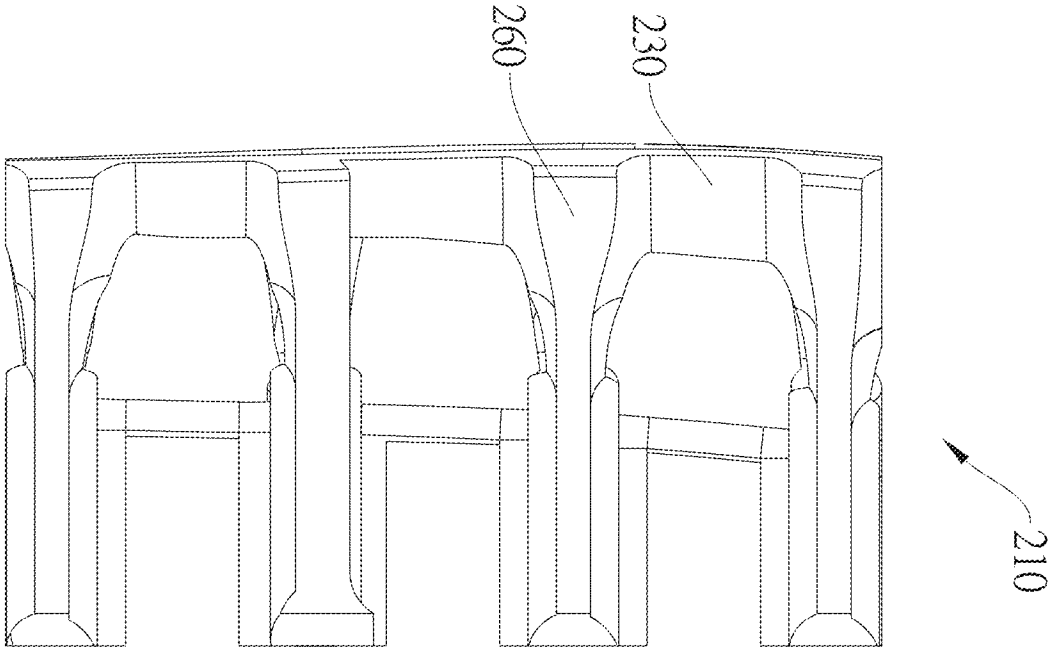
FIG. 13 is a side view of the frame body of the curved surface air cushion product according to the second embodiment of the present invention.

In other embodiments, as shown in FIG. 11, the fixing means for aligning each first air cushion portion 10 with each second air cushion portion 20 side by side is a frame body 210 that surrounds the three-dimensional curved surface air cushion module 100. The frame body 210 is made of a foam material and corresponds to the shape of the three-dimensional curved surface air cushion module 100. The process for making the frame body 210 includes placing the three-dimensional curved surface air cushion module 100 into a foaming mold, then filling the foaming mold with a foaming material. The foaming material foams inside the foaming mold to form the frame body 210, corresponding to the contour of the three-dimensional curved surface air cushion module 100. This process allows the frame body 210 to enclose and fix the three-dimensional curved surface air cushion module 100. Referring to FIG. 12 and FIG. 13, the frame body 210 includes a plurality of first frames 220 and a plurality of second frames 230, which correspond to the number of first air cushion portions 10 and the number of second air cushion portions 20, respectively. The first frames 220 are respectively fixed around the first air cushion portions 10, wherein the first curved surface 13 and the first connecting surface 14 of each first air cushion portion 10 are exposed at each first frame 220. The second frames 230 are respectively fixed around the second air cushion portions 20, wherein the second curved surface 23 and the second connecting surface 24 of each second air cushion portion 20 are exposed at each second frame 230. A rib 240 is disposed between each first frame 220 and each second frame 230, wherein the ribs 240 are inserted into the gap P between the first air cushion portions 10 and the second air cushion portions 20.

Additionally, a first insert block 250 is disposed between every two adjacent first frames 220, and a second insert block 260 is disposed between every two adjacent second frames 230. Each first insert block 250 and each second insert block 260 connect to each rib 240. Each first insert block 250 is inserted into the first gap 17 between two adjacent first air cushion portions 10. Each first insert block 250 has a first support column 270, wherein the first support column 270 is placed in the first clamping groove 18 of each first gap 17. Each second insert block 260 is inserted into the second gap 27 between two adjacent second air cushion portions 20. Each second insert block 260 has a second support column 280, wherein the second support column 280 is placed in the second clamping groove 28 of each second gap 27. This arrangement eliminates the need for adhesive. The first air cushion portions 10 and the second air cushion portions 20 of the three-dimensional curved surface air cushion module 100 are fixed and aligned side by side through the frame body 210. Furthermore, the frame body 210 fills the gaps and clamping grooves between the adjacent first air cushion portions 10 and between the adjacent second air cushion portions 20, thus reinforcing the support strength of the three-dimensional curved surface air cushion module 100 and enhancing the structural stability of the curved surface air cushion product 200.

In other embodiments, the curved surface air cushion product 200 could be adjusted in structure according to needs. For example, the curved surface air cushion product 200 could correspond to the structure of the three-dimensional curved surface air cushion module 100, which includes at least one first air cushion portion 10 and at least one second air cushion portion 20. When the curved surface air cushion product 200 includes one first air cushion portion 10 and one second air cushion portion 20, the fixing means of the three-dimensional curved surface air cushion module 100 is the adhesive placed in the gap P between the first inner surface 11 of the first air cushion portion 10 and the second inner surface 21 of the second air cushion portion 20. Alternatively, the fixing means of the three-dimensional curved surface air cushion module 100 could be the frame body 210, wherein the frame body 210 is fixed around the first air cushion portion 10 and the second air cushion portion 20 with at least one first frame 220 and at least one second frame 230, respectively. The rib 240 disposed between the at least one first frame 220 and the at least one second frame 230 is inserted into the gap P. The fixing means of the three-dimensional curved surface air cushion module 100 could also use the rigid curved panel attached to the continuous curved surface 110 to fix the first air cushion portion 10 and the second air cushion portion 20 side by side.

Figure 14:
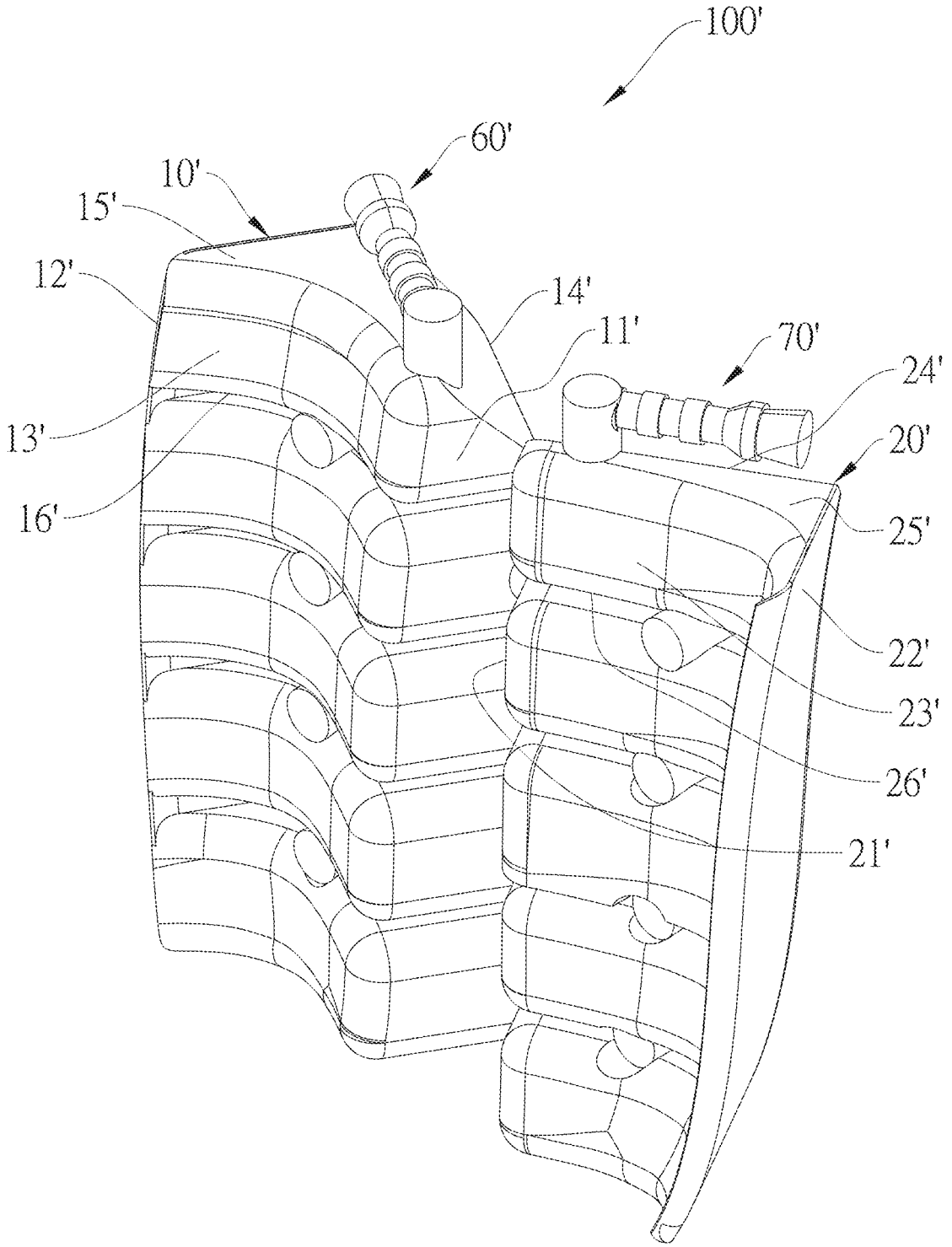
FIG. 14 is a perspective view of the three-dimensional curved surface air cushion module according to a third embodiment of the present invention.
Figure 15:
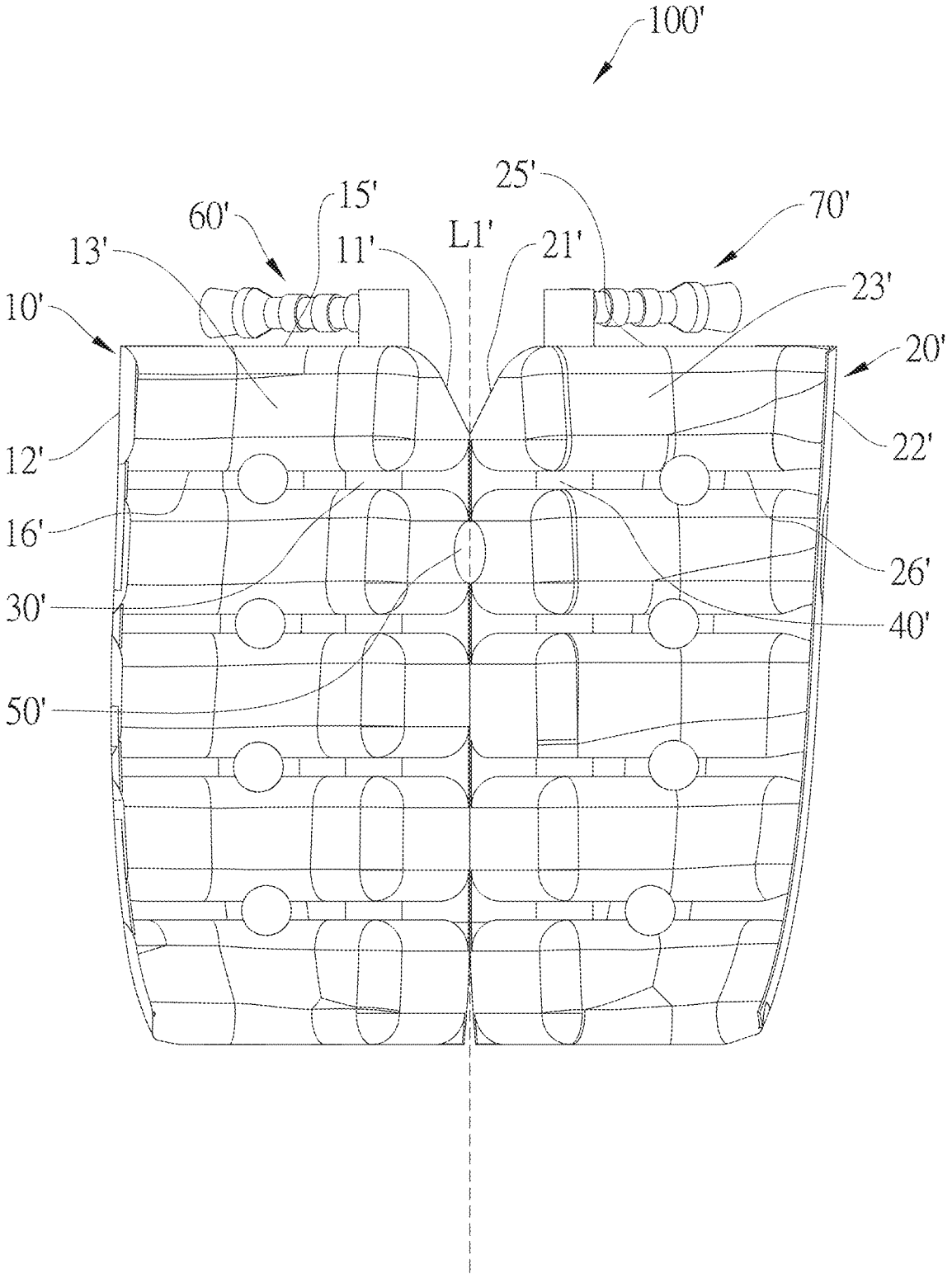
FIG. 15 is a front view of the three-dimensional curved surface air cushion module according to the third embodiment of the present invention.

A three-dimensional curved surface air cushion module 100' according to a third embodiment of the present invention is illustrated in FIG. 14 and FIG. 15. The three-dimensional curved surface air cushion module 100' includes a plurality of first air cushion portions 10', a plurality of second air cushion portions 20', a plurality of first axial communication portions 30', a plurality of second axial communication portions 40', a lateral communication portion 50', a first fluid-filled portion 60', and a second fluid-filled portion 70'. In the current embodiment, detailed structure of each first air cushion portion 10', each second air cushion portion 20', each first axial communication portion 30', each second axial communication portion 40', and the lateral communication portion 50' is basically the same as the corresponding components of the three-dimensional curved surface air cushion module 100 described in the first embodiment, including each first air cushion portion 10, each second air cushion portion 20, each first axial communication portion 30, each second axial communication portion 40, and lateral communication portion 50. For example, the first air cushion portions 10' and second air cushion portions 20' are pivotally connected. A pivot fold line L1' is defined at a pivot connection located between the first air cushion portions 10' and the second air cushion portions 20'. The first air cushion portions 10' are arranged in parallel along the pivot fold line L1' and are connected to each other, and the second air cushion portions 20' are arranged in parallel along the pivot fold line L1' and are connected to each other. Each first axial communication portion 30' communicates with two adjacent first air cushion portions 10', and each second axial communication portion 40' is communicates with two adjacent second air cushion portions 20'. The lateral communication portion 50' is disposed between one of the first air cushion portions 10' and an adjacent second air cushion portion 20'. The three-dimensional curved surface air cushion module 100' is in a semi-finished state which is not yet filled with fluid.

Each first air cushion portion 10' has a first inner surface 11', a first outer surface 12', a first curved surface 13', a first connecting surface 14', a first front surface 15', and a first rear surface 16'. Each first outer surface 12' has a first upper edge 121' and a first lower edge 122', which are respectively located on two ends of each first outer surface 12'. Each first curved surface 13' extends upward in an arc from each first inner surface 11' to each first outer surface 12' and is connected to each first upper edge 121'. Each first connecting surface 14' is connected in a straight line, relative to each first curved surface 13', to the first lower edge 122' of each first outer surface 12' and each first inner surface 11'. Each first front surface 15' and each first rear surface 16' are arranged along a direction of the pivot fold line L1' and connect to each first inner surface 11', each first outer surface 12', each first curved surface 13', and each first connecting surface 14'. The first connecting surfaces 14' are coplanar with the first outer surfaces 12'.

The first fluid-filled portion 60' is disposed on the first front surface 15' of the first air cushion portion 10', which is located at the top. The first fluid-filled portion 60' is a nozzle, and the first air cushion portions 10' communicate with each other through the first axial communication portions 30'. The first fluid-filled portion 60' is used to controllably fill fluid into the first air cushion portions 10'. In other embodiments, the first fluid-filled portion 60' could be adjustably disposed on one of the first air cushion portions 10'. Alternatively, the number of first fluid-filled portions 60' could be plural, corresponding to the number of the first air cushion portions 10', wherein the first fluid-filled portions 60' are disposed on the respective first air cushion portions 10'.

Each second air cushion portion 20' has a second inner surface 21', a second outer surface 22', a second curved surface 23', a second connecting surface 24', a second front surface 25', and a second rear surface 26'. Each first inner surface 11' and each second inner surface 21' face each other. Each second outer surface 22' has a second upper edge 221' and a second lower edge 222', which are respectively located on two ends of each second outer surface 22'. Each second curved surface 23' corresponds to the contour and position of each first curved surface 13'. Each second curved surface 23' extends upward in an arc from each second inner surface 21' to each second outer surface 22' and is connected to each second upper edge 221'. Each second connecting surface 24' is connected in a straight line, relative to each second curved surface 23', to the second lower edge 222' of each second outer surface 22' and each second inner surface 21'. Each second connecting surface 24' is connected to each first connecting surface 14'. Each second front surface 25' and each second rear surface 26' are arranged along the direction of the pivot fold line L1' and connect to each second inner surface 21', each second outer surface 22', each second curved surface 23', and each second connecting surface 24'. The second connecting surfaces 24' are coplanar with the second outer surfaces 23'.

The second fluid-filled portion 70' is disposed on the second front surface 25' of the second air cushion portion 20', which is located at the top. The second fluid-filled portion 70' is also a nozzle, and the second air cushion portions 20' communicate with each other through the second axial communication portions 40'. The second fluid-filled portion 70' is used to controllably fill fluid into the second air cushion portions 20'. In other embodiments, the second fluid-filled portion 70' could be adjustably disposed on one of the second air cushion portions 20'. Alternatively, the number of the second fluid-filled portion 70' could be plural, corresponding to the number of the second air cushion portions 20', wherein the second fluid-filled portions 70' are disposed on the respective second air cushion portions 20'.

Figure 16:
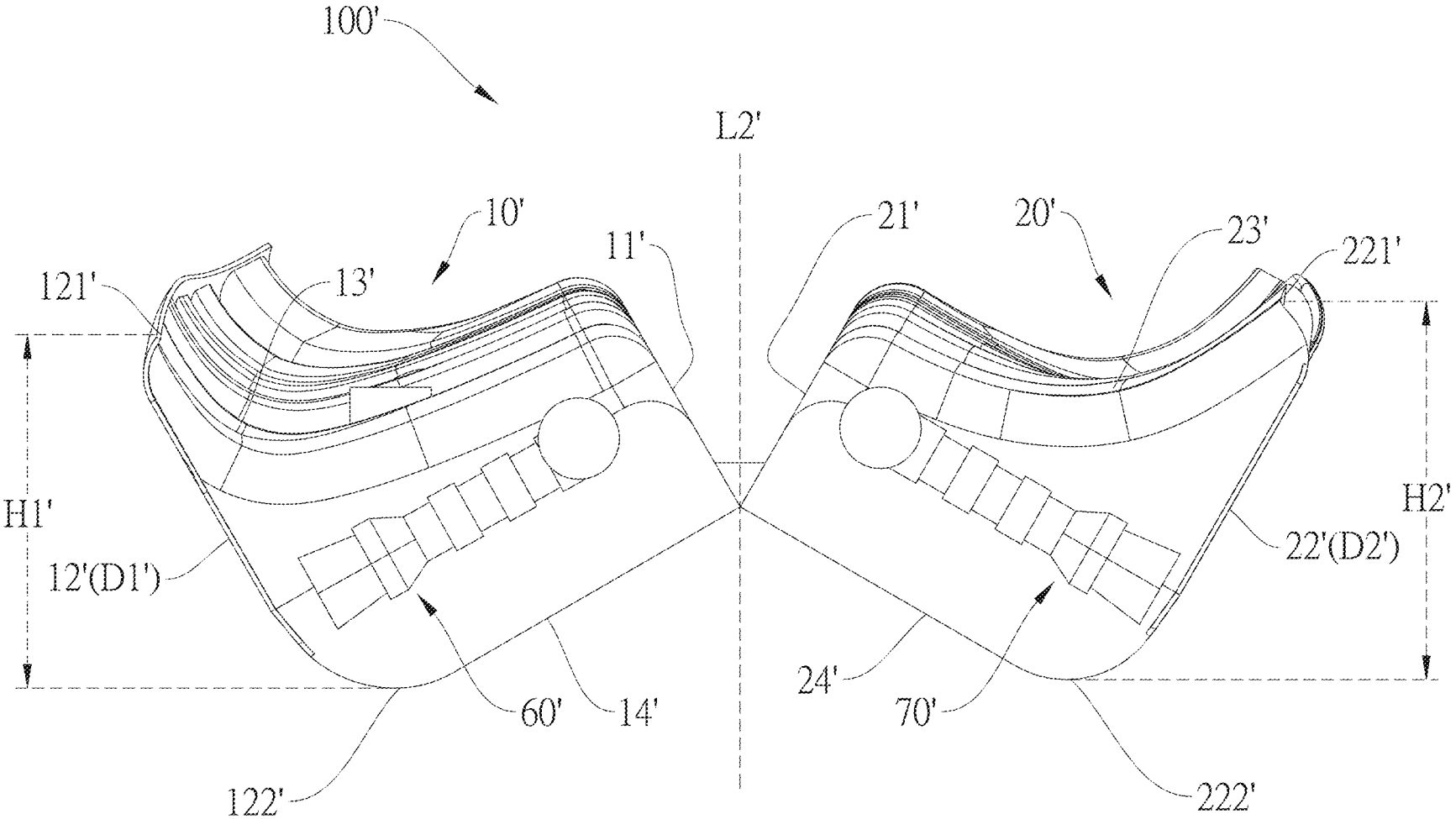
FIG. 16 is a top view of the three-dimensional curved surface air cushion module according to the third embodiment of the present invention.

As shown in FIG. 16, each first air cushion portion 10' and each second air cushion portion 20' are pivotally opened along the pivot fold line L', so that each first outer surface 12' and each second outer surface 22' tilt relative to each other. At this time, a first height H1' is defined between each first upper edge 121' and each first lower edge 122', wherein each first height H1' is less than a wall height D1' of each first outer surface 12'. A second height H2' is defined between each second upper edge 221' and each second lower edge 222', the second height H2' is less than a wall height D2' of each second outer surface 22'. Thus, the three-dimensional curved surface air cushion module 100' could directly fill the first air cushion portions 10' and the second air cushion portions 20' with fluid through the first fluid-filled portion 60' and the second fluid-filled portion 70' during the filling process. Moreover, the first air cushion portions 10' and the second air cushion portions 20' are pivoted along the pivot fold line L1', so that the first air cushion portions 10' and the second air cushion portions 20' open relative to each other. In this way, the first outer surface 12' of each first air cushion portion 10' and the second outer surface 22' of each second air cushion portion 20' tilt relative to each other, thereby reducing a maximum sidewall height of each first air cushion portion 10' and a maximum sidewall height of each second air cushion portion 20' in the air cushion molding mold. Thus, ultimately improving the molding yield of the three-dimensional curved surface air cushion module 100'.

Figure 17:
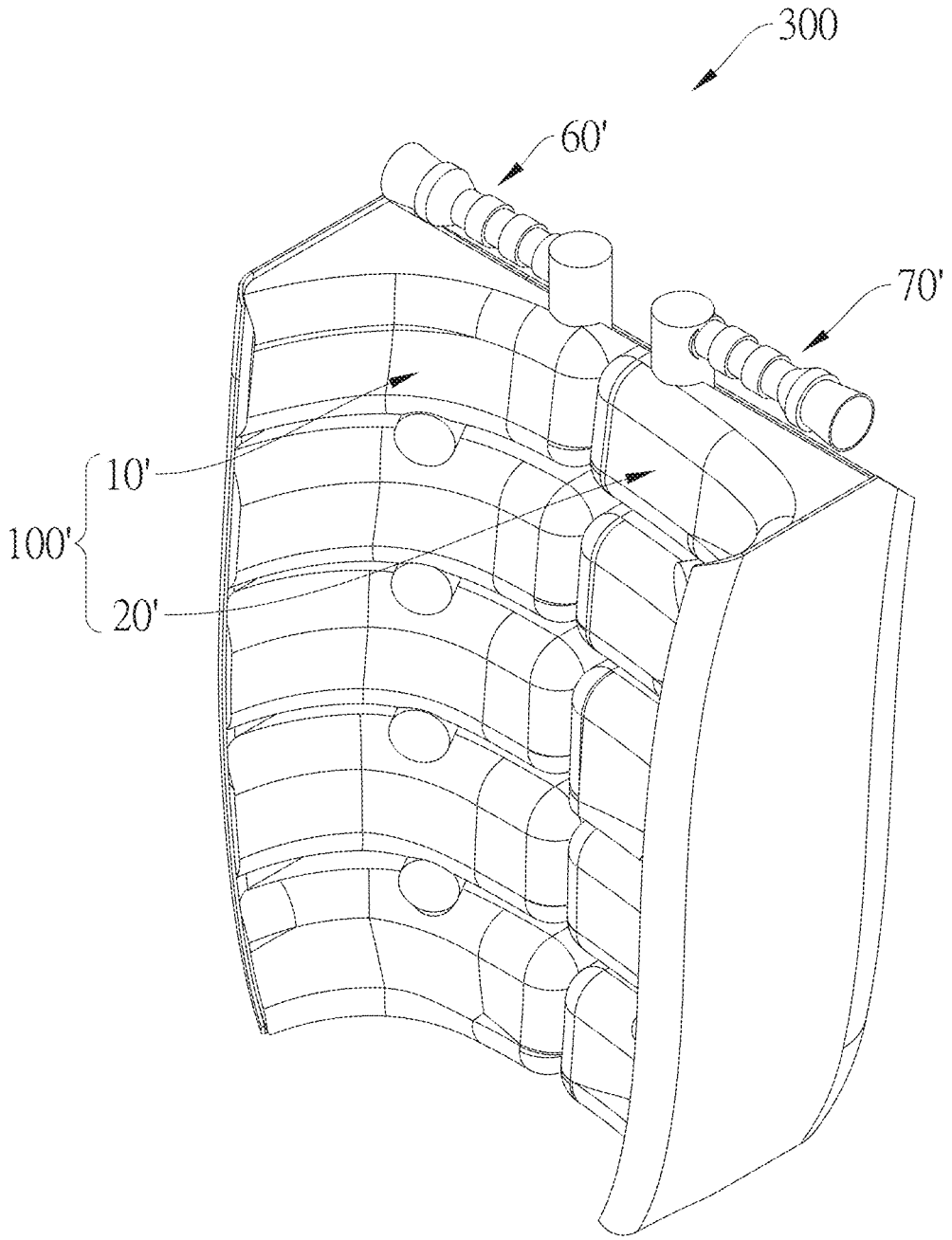
FIG. 17 is a perspective view of the curved surface air cushion product, which includes the three-dimensional curved surface air cushion module in the third embodiment, according to a fourth embodiment of the present invention.

A curved surface air cushion product 300 according to a fourth embodiment of the present invention is illustrated in FIG. 17. The curved surface air cushion product 300 includes the three-dimensional curved surface air cushion module 100' of the third embodiment. The configuration of the curved surface air cushion product 300 is basically the same as the configuration of the curved surface air cushion product 200 of the second embodiment. In the current embodiment, each first air cushion portion 10' and each second air cushion portion 20' are respectively filled with the fluid.

Figure 18:
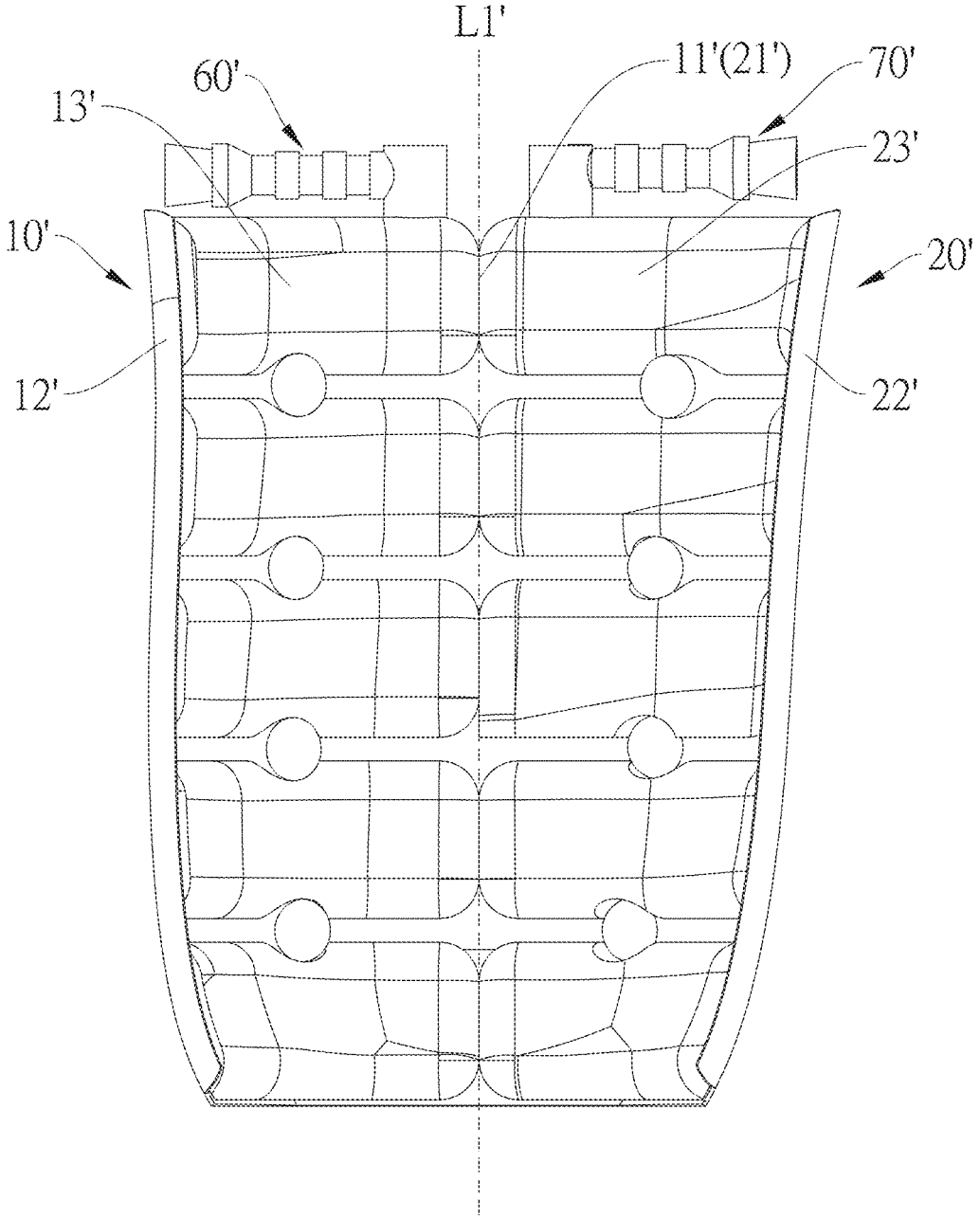
FIG. 18 is a front view of the curved surface air cushion product according to the fourth embodiment of the present invention.
Figure 19:
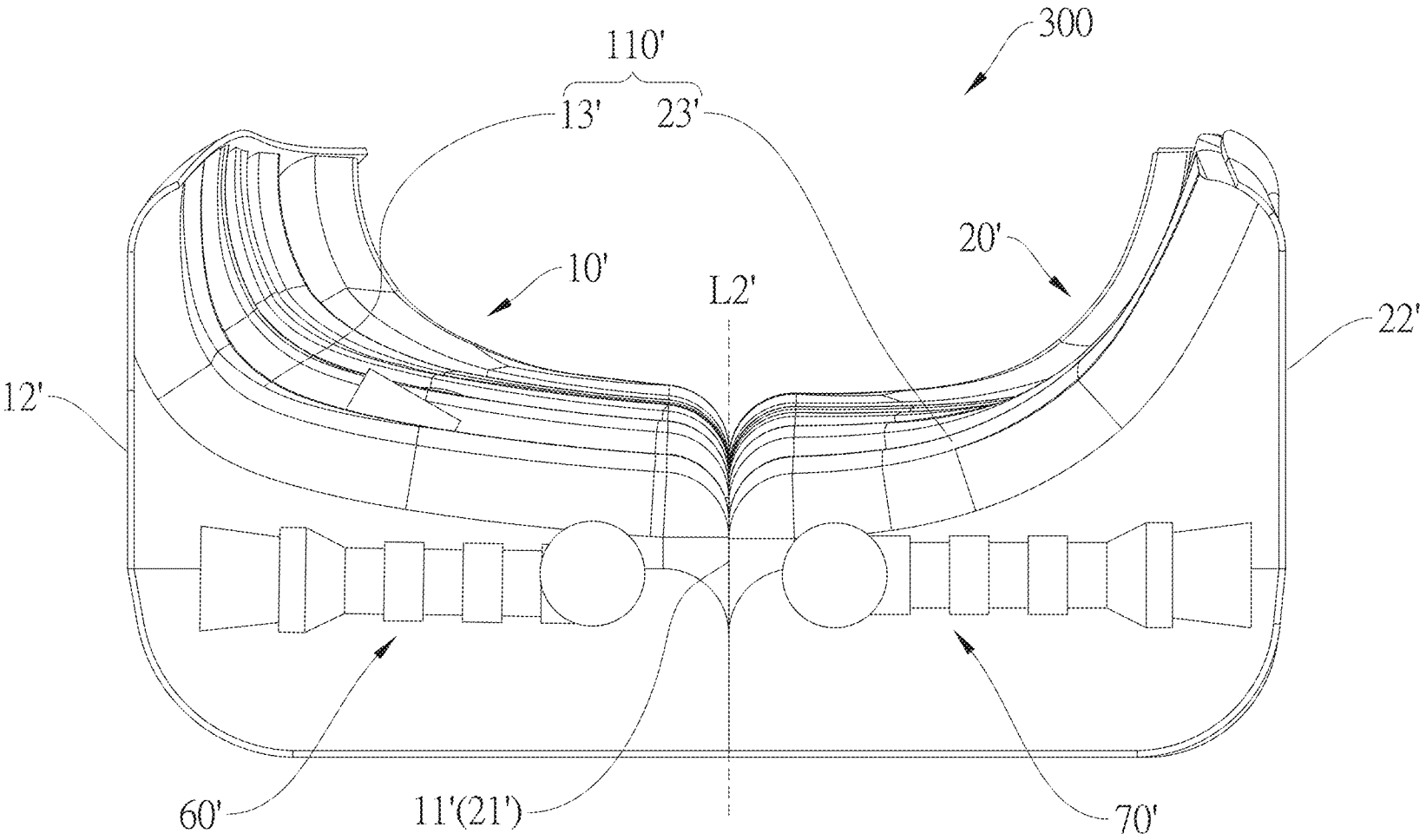
FIG. 19 is a rear view of the curved surface air cushion product according to the fourth embodiment of the present invention.

As shown in FIG. 18 and FIG. 19, in the current embodiment, each first air cushion portion 10' and each second air cushion portion 20' are symmetrically disposed with the pivot fold line L1' as the center. Each first air cushion portion 10' and each second air cushion portion 20' are fixed by a fixing means to obtain the curved surface air cushion product 300. The fixing means of the three-dimensional curved surface air cushion module 100' could be processed using the adhesive or the frame body (not shown) employed in the aforementioned second embodiment. At this time, the second inner surface 21' of each second air cushion portion 20' and the first inner surface 11' of each first air cushion portion 10' face each other, and each second curved surface 23' and each first curved surface 13' face each other. The first curved surfaces 13' and the second curved surfaces 23' are located adjacent to each other to form a continuous curved surface 110'. In the continuous curved surface 110', each first curved surface 13' and each second curved surface 23' extend upward in an arc shape from each first inner surface 11' and each second inner surface 21' toward each first outer surface 12' and each second outer surface 22', respectively.

Figure 20:
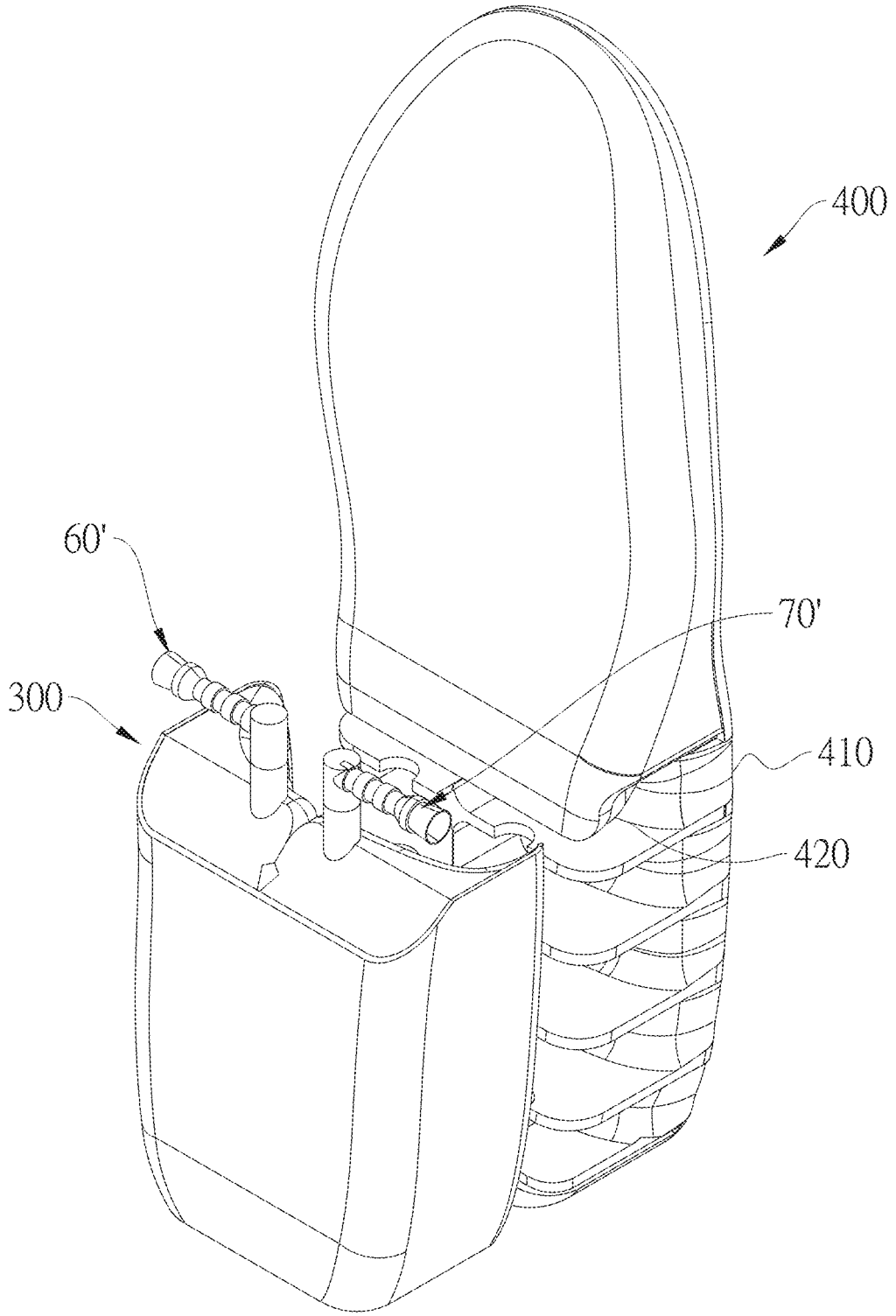
FIG. 20 a perspective view of the curved surface air cushion product, paired with the foam shoe body, according to the fourth embodiment of the present invention.
Figure 21:
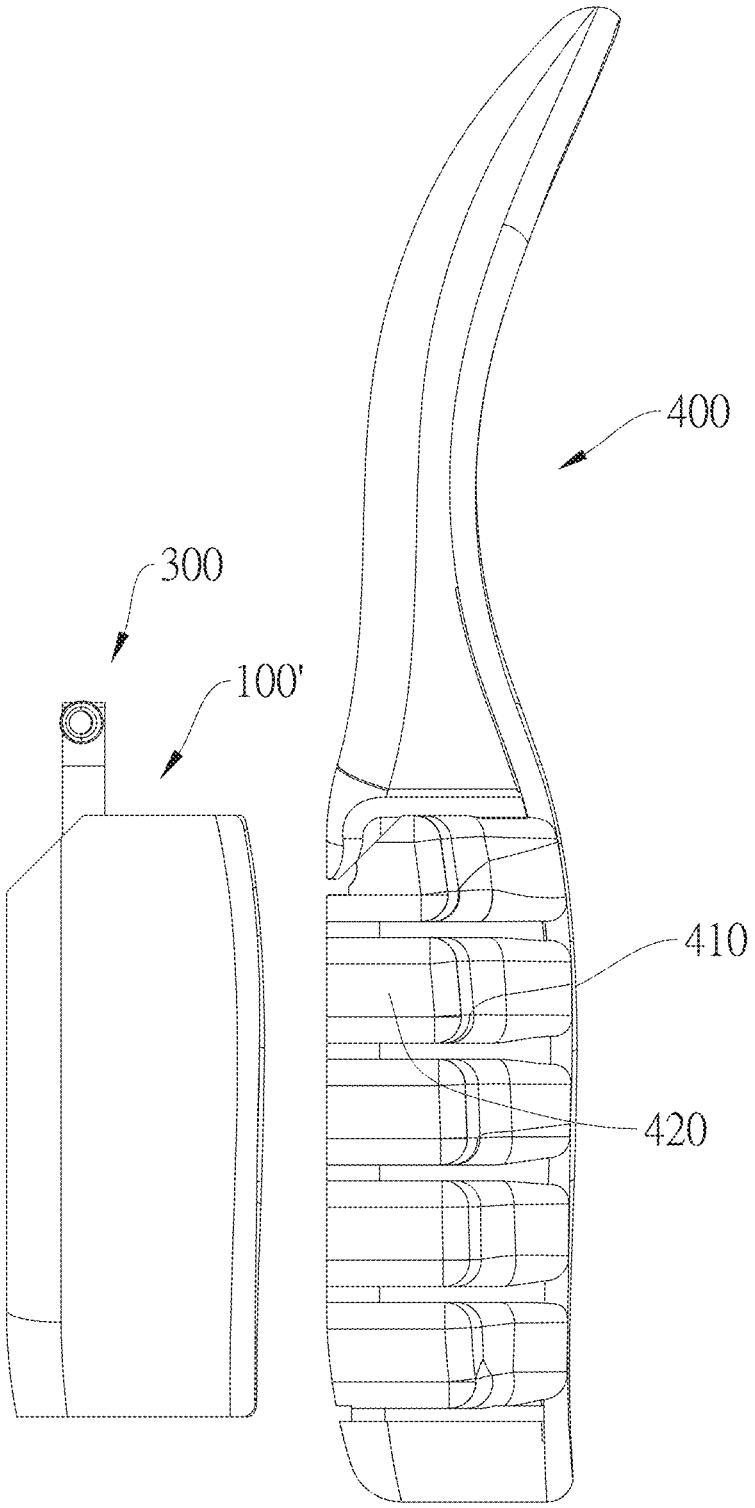
FIG. 21 a side view of the curved surface air cushion product, paired with the foam shoe body, according to the fourth embodiment of the present invention.
Figure 22:
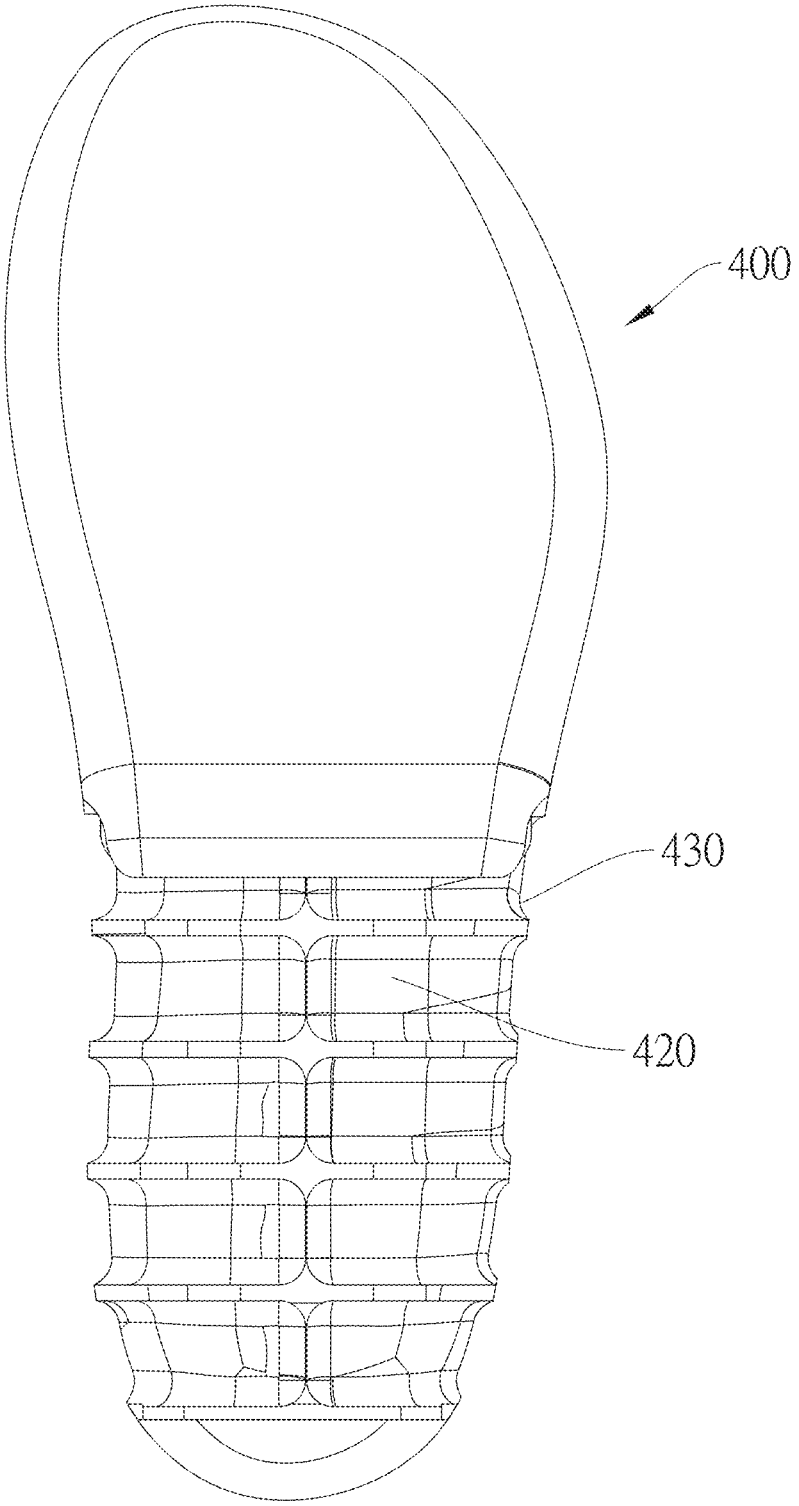
FIG. 22 a bottom view of the foam shoe body of the curved surface air cushion product according to the fourth embodiment of the present invention.

Moreover, in FIG. 20, the fixing means of the curved surface air cushion product 300 includes integrally foaming a foam shoe body 400 and combining the foam shoe body 400 with the three-dimensional curved surface air cushion module 100'. In the current embodiment, the three-dimensional curved surface air cushion module 100' combined with the foam shoe body 400 is described as an example of a shoe outsole. The process for making the foam shoe body 400 includes placing the curved surface air cushion product 300 into a foaming mold, then filling the foaming mold with a foaming material to form the foam shoe body 400. Thus, the foam shoe body 400 corresponds to the contour of the first air cushion portions 10' and the contour of second air cushion portions 20'. This process allows the foam shoe body 400 to enclose and fix the three-dimensional curved surface air cushion module 100'. As shown in FIG. 21 and FIG. 22, a heel portion 410 of the foam shoe body 400 has a plurality of accommodating grooves 42. The accommodating grooves 42 correspond to the contours and arrangement of the first air cushion portions 10' and the second air cushion portions 20' of the curved surface air cushion product 300. The first air cushion portions 10' and the second air cushion portions 20' are each fixed in the respective accommodating grooves 420. A plurality of walls of the accommodating grooves 420 is inserted into a plurality of first gaps 17' and a plurality of first clamping grooves 18' of the first air cushion portions 10', as well as a plurality of second gaps 27' and a plurality of second clamping grooves 28' of the second air cushion portions 20'. Each accommodating groove 420 has a side opening 430. When the curved surface air cushion product 300 is installed in the heel portion 410 of the foam shoe body 400, the first outer surfaces 12' of the first air cushion portions 10' and the second outer surfaces 22' of the second air cushion portions 20' are exposed through the side openings 430 of the accommodating grooves 420. The curved surface air cushion product 300 provides elastic support to the foam shoe body 400, and the side openings 430 of the foam shoe body 400 allow the appearance and color of the first air cushion portions 10' and the second air cushion portions 20' to be displayed, enhancing the visual aesthetics of the foam shoe body 400.

Figure 23:
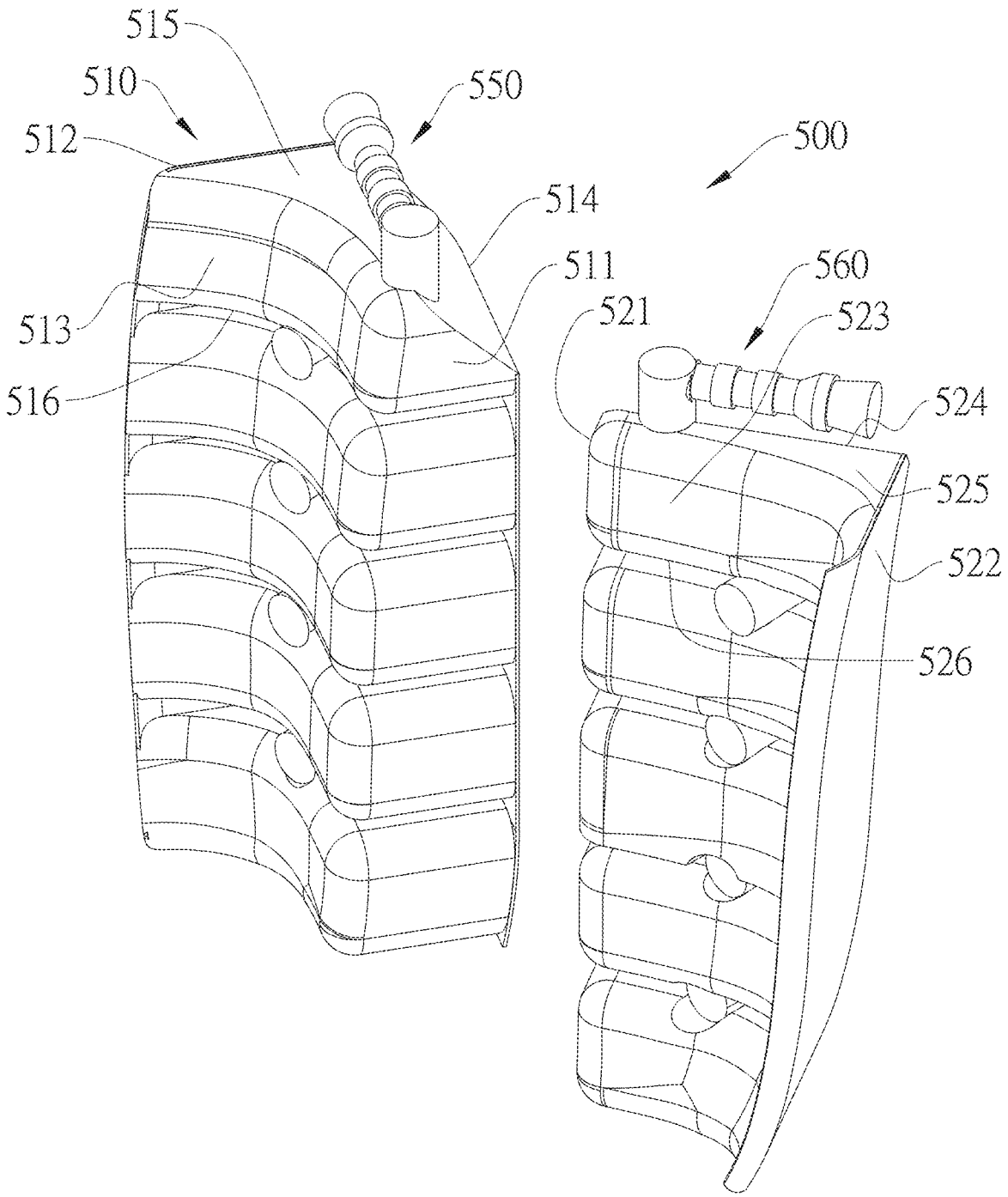
FIG. 23 is a perspective view of the three-dimensional curved surface air cushion module according to a fifth embodiment of the present invention.

A three-dimensional curved surface air cushion module 500 according to a fifth embodiment of the present invention is illustrated in FIG. 23. The three-dimensional curved surface air cushion module 500 includes a plurality of first air cushion portions 510, a plurality of second air cushion portions 520, a plurality of first axial communication portions 530, a plurality of second axial communication portions 540, a first fluid-filled portion 550, and a second fluid-filled portion 560. In the current embodiment, detailed structure of each first air cushion portion 510, each second air cushion portion 520, each first axial communication portion 530, each second axial communication portion 540, the first fluid-filled portion 550, and the second fluid-filled portion 560 is basically the same as the corresponding components of the three-dimensional curved surface air cushion module 100' described in the third embodiment, including each first air cushion portion 10', each second air cushion portion 20', each first axial communication portion 30', each second axial communication portion 40', the first fluid-filled portion 60', and the second fluid-filled portion 70'. However, in the current embodiment, as shown in FIG. 24, the first air cushion portions 510 and the second air cushion portions 520 are separate components and are not connected to each other.

Figure 24:
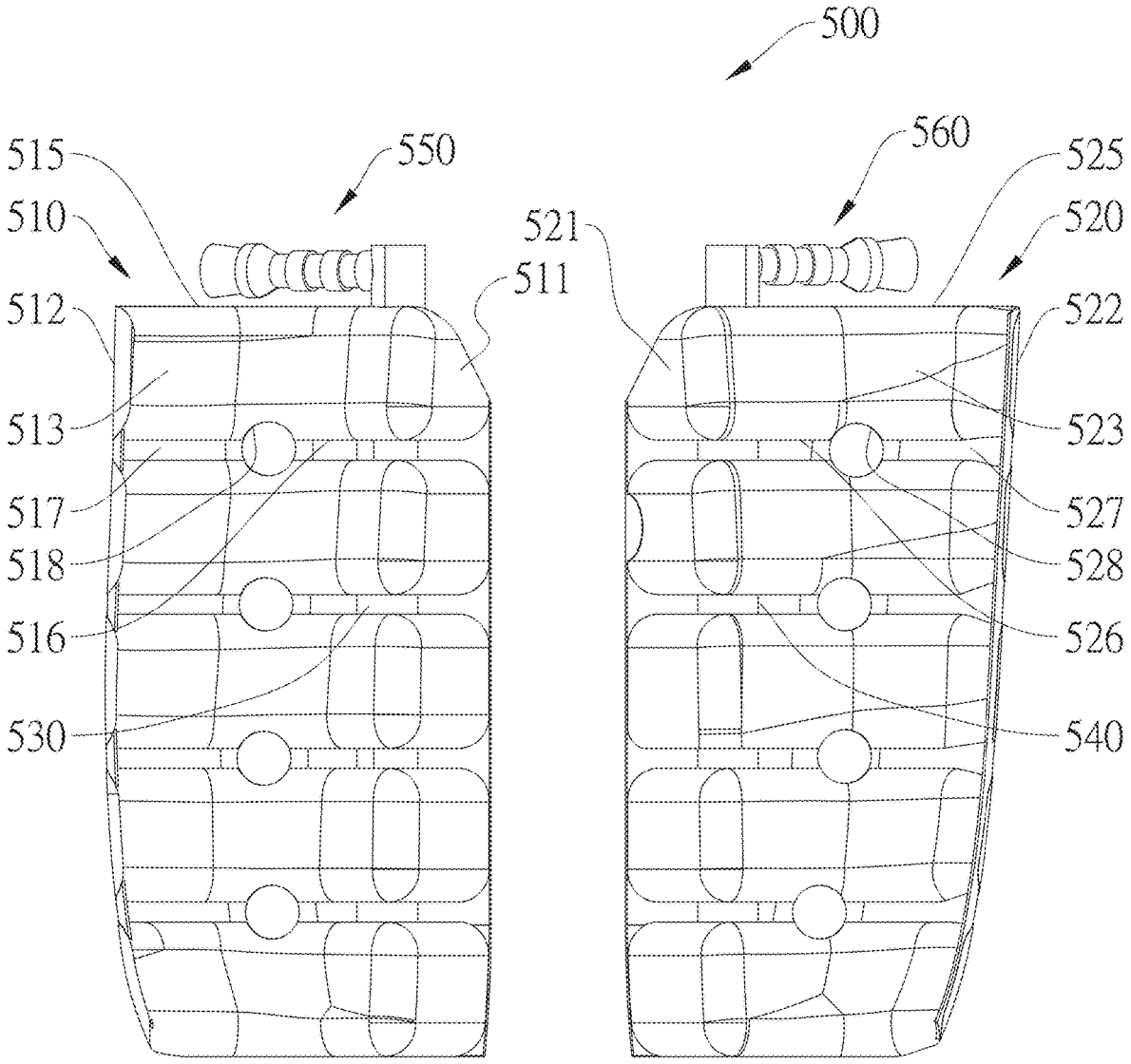
FIG. 24 is a front view of the three-dimensional curved surface air cushion module according to the fifth embodiment of the present invention.
Figure 25:
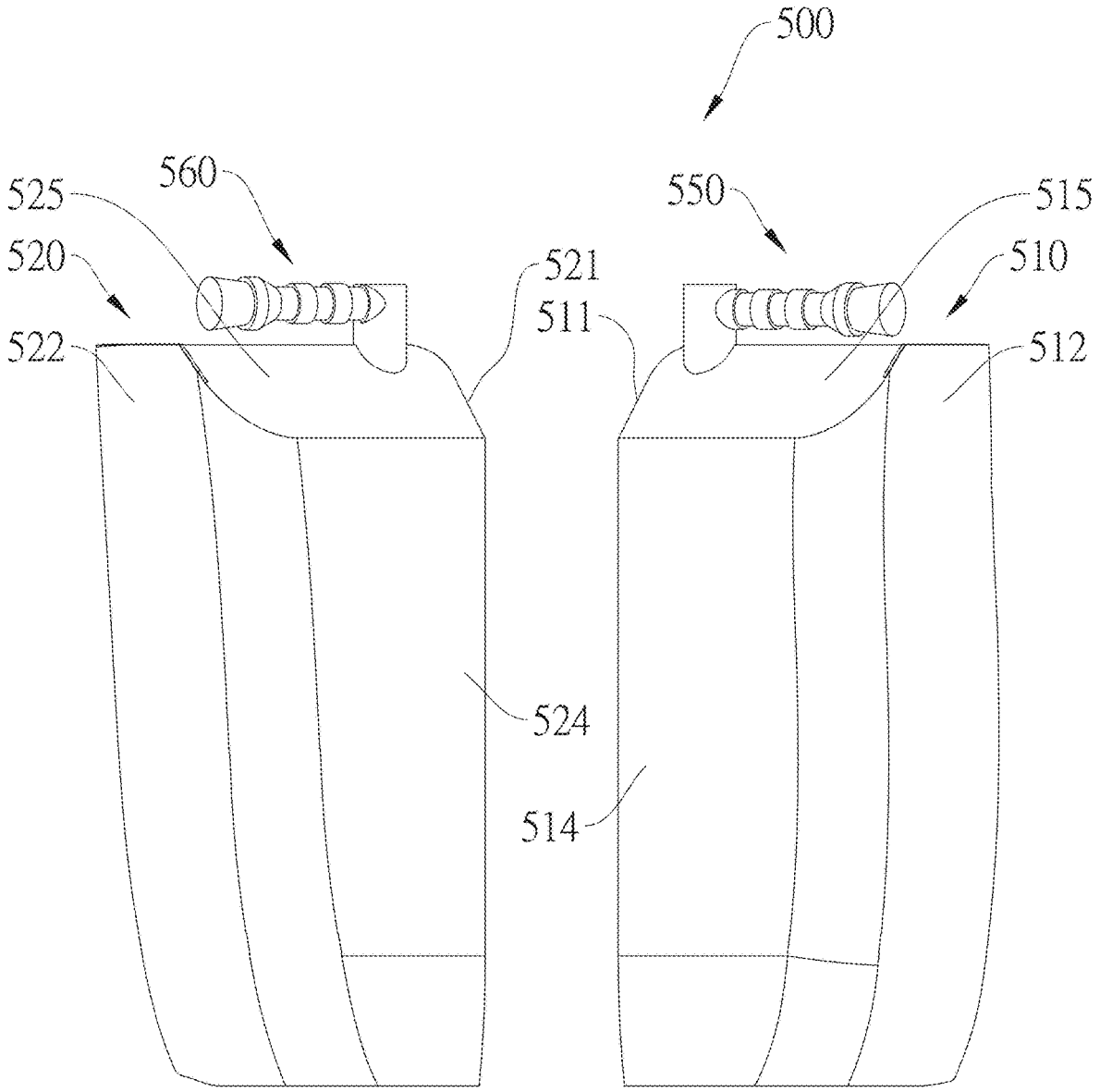
FIG. 25 is a rear view of the three-dimensional curved surface air cushion module according to the fifth embodiment of the present invention.

As shown in FIG. 24 and FIG. 25, each first air cushion portion 510 has a first inner surface 511, a first outer surface 512, a first curved surface 513, and a first connecting surface 514. Each first inner surface 511 and each first outer surface 512 are located on two opposite sides of each first air cushion portion 510. Each first curved surface 513 extends upward in an arc from each first inner surface 511 to each first outer surface 512. Each first connecting surface 514 is connected in a straight line, relative to each first curved surface 513, to each first outer surface 512 and each first inner surface 511. The first connecting surfaces 514 are coplanar with the first outer surfaces 512. Moreover, a first gap 517 is provided between every two adjacent first air cushion portions 510. A first clamping groove 518 is provided between every two adjacent first air cushion portions 510. Each first clamping groove 518 is recessed from each first curved surface 513 toward each first connecting surface 514 within the corresponding first gap 517. Each first axial communication portion 530 is disposed in the corresponding first gap 517 between every two adjacent first air cushion portions 510. Each first axial communication portion 530 is communicated with a first front surface 515 of one of the first air cushion portions 510 and a first rear surface 516 of an adjacent first air cushion portion 510. The first fluid-filled portion 550 is disposed on the first front surface 515 of the first air cushion portion 510, which is located at the top. The first fluid-filled portion 550 is used to controllably fill fluid into the first air cushion portions 510.

Each second air cushion portion 520 has a second inner surface 521, a second outer surface 522, a second curved surface 523, and a second connecting surface 524. Each second inner surface 521 and each second outer surface 522 are located on two opposite sides of each second air cushion portion 520. Each second curved surface 523 extends upward in an arc from each second inner surface 521 to each second outer surface 522. Each second connecting surface 524 is connected in a straight line, relative to each second curved surface 523, to each second outer surface 522 and each second inner surface 521. The second connecting surfaces 524 are coplanar with the second outer surfaces 522. Moreover, a second gap 527 is provided between every two adjacent second air cushion portions 520. A second clamping groove 528 is provided between every two adjacent second air cushion portions 520. Each second clamping groove 528 is recessed from each second curved surface 523 toward each second connecting surface 524 within the corresponding second gap 527. Each second axial communication portion 540 is disposed in the corresponding second gap 527 between every two adjacent second air cushion portions 520. Each second axial communication portion 540 is communicated with a second front surface 525 of one of the second air cushion portions 520 and a second rear surface 526 of an adjacent second air cushion portion 520. The second fluid-filled portion 560 is disposed on the second front surface 525 of the second air cushion portion 520, which is located at the top. The second fluid-filled portion 560 is used to controllably introduce fluid into the second air cushion portions 520.

In other embodiments, the structure and arrangement of the three-dimensional curved surface air cushion module 500 could be adjusted as needed. For example, the first axial communication portions 530 and the second axial communication portions 540 could be omitted, provided that each first air cushion portion 510 and each second air cushion portion 520 could independently be filled with fluid. It is not required for adjacent first air cushion portions 510 or adjacent second air cushion portions 520 to communicate with one another. The number of the first air cushion portion 510 and the number of the second air cushion portion 520 could each be at least one. The first fluid-filled portion 550 and the second fluid-filled portion 560 could also be omitted.

In the fifth embodiment, during the actual molding process of the three-dimensional curved surface air cushion module 500, the first air cushion portions 510 and the second air cushion portions 520 are respectively placed into an air cushion molding mold (not shown). The first air cushion portions 510 and the second air cushion portions 520 tilt in a molding cavity of the air cushion molding mold, so that the first outer surface 512 of each first air cushion portion 510 and the second outer surface 522 of each second air cushion portion 520 tilt respectively. This arrangement reduces a maximum sidewall height of each first air cushion portion 510 and a maximum sidewall height of each second air cushion portion 520 in the air cushion molding mold. Additionally, the filling pressure of each first air cushion portion 510 and each second air cushion portion 520 could be independently controlled according to the requirements.

Figure 26:
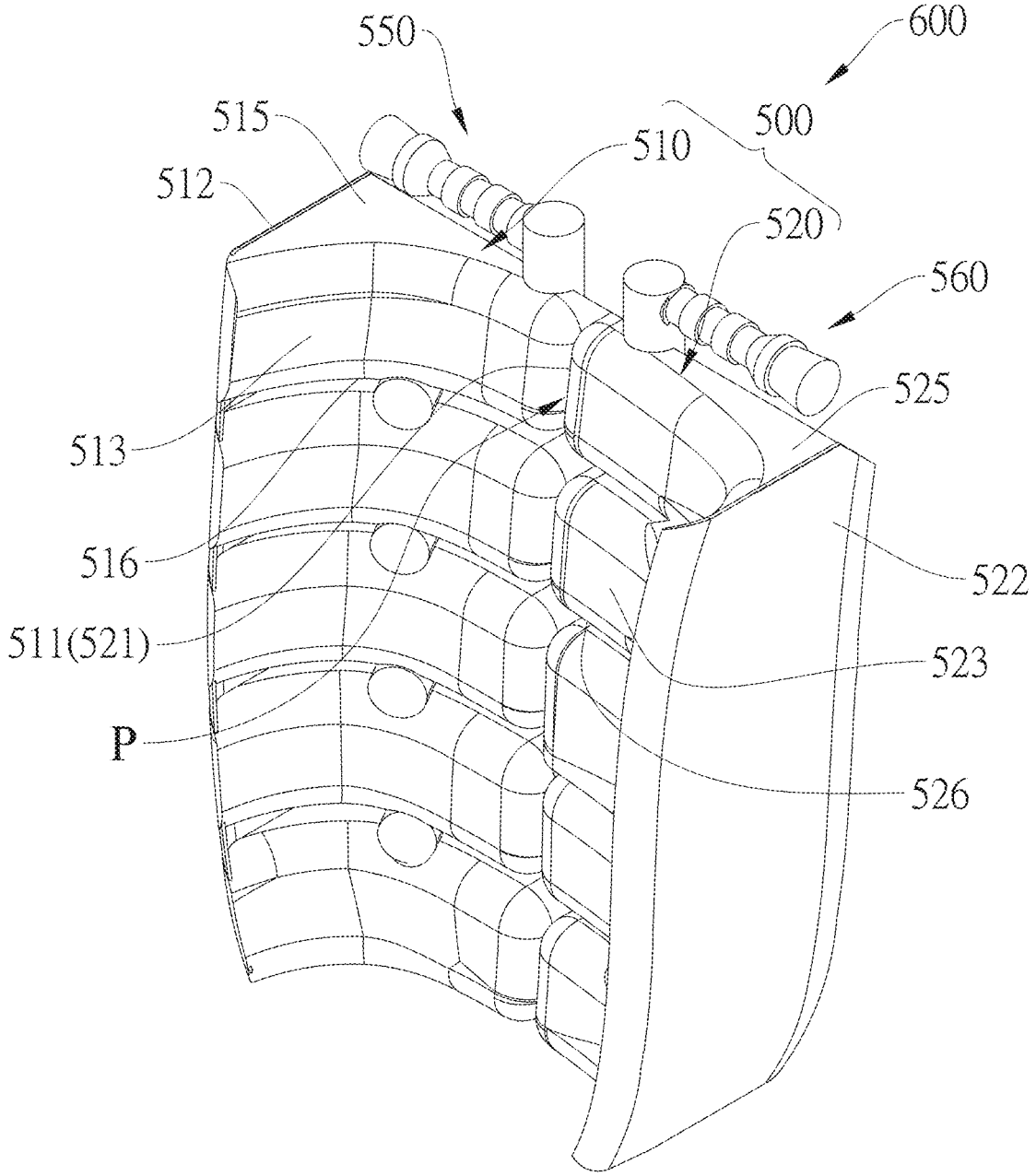
FIG. 26 is a perspective view of the curved surface air cushion product, which includes the three-dimensional curved surface air cushion module in the fifth embodiment, according to a sixth embodiment of the present invention.

A curved surface air cushion product 600 according to a sixth embodiment of the present invention is illustrated in FIG. 26. The curved surface air cushion product 600 includes the three-dimensional curved surface air cushion module 500 of the fifth embodiment. The configuration of the curved surface air cushion product 600 is basically the same as the configuration of the curved surface air cushion product 300 of the fourth embodiment. In the sixth embodiment, each first air cushion portion 510 and each second air cushion portion 520 are respectively filled with the fluid.

Figure 27:
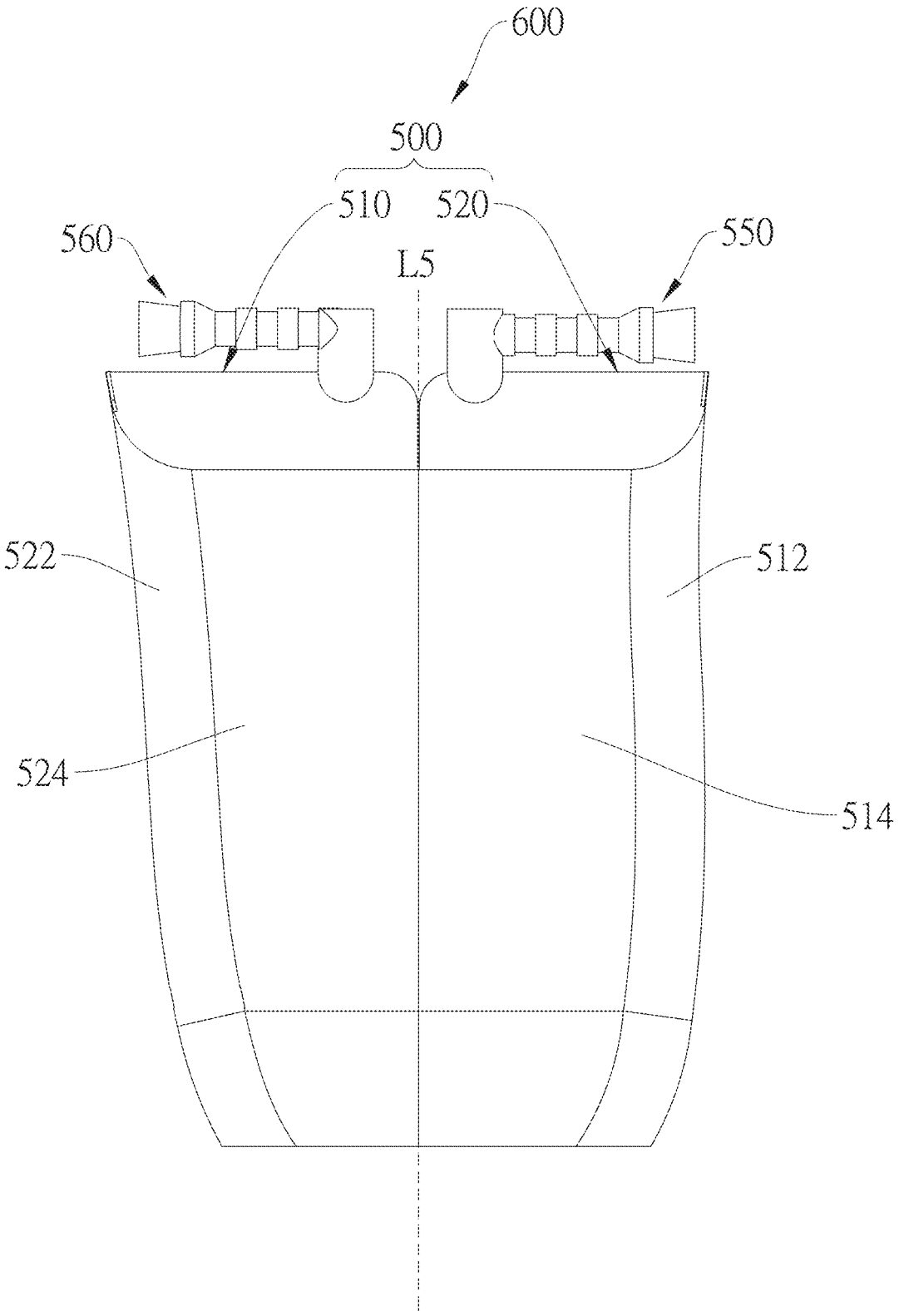
FIG. 27 is a rear view of the curved surface air cushion product according to the sixth embodiment of the present invention.
Figure 28:
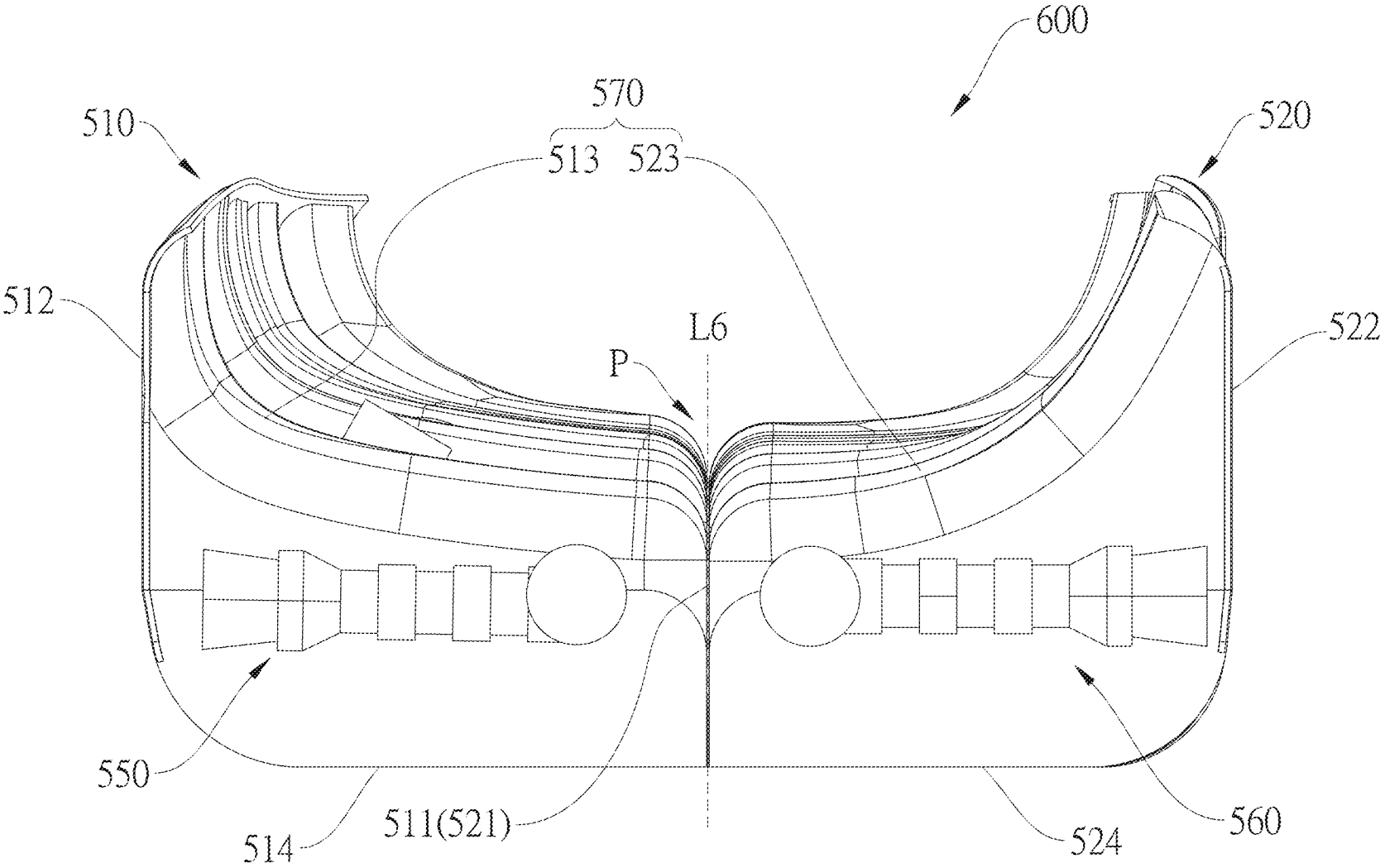
FIG. 28 is a top view of the curved surface air cushion product according to the sixth embodiment of the present invention.

In the sixth embodiment, as shown in FIG. 26 to FIG. 28, each first air cushion portion 510 and each second air cushion portion 520 are fixed by a fixing means. The fixing means of the three-dimensional curved surface air cushion module 500 could be processed using the adhesive or the frame body (not shown) employed in the aforementioned second embodiment. Thus, the second inner surface 521 of each second air cushion portion 520 and the first inner surface 511 of each first air cushion portion 510 face each other, and each second curved surface 523 and each first curved surface 513 face each other. The first curved surfaces 513 and the second curved surfaces 523 are located adjacent to each other to form a continuous curved surface 570. The curvature of the continuous curved surface 570 is substantially the same as the curvature of the continuous curved surface 110' in the fourth embodiment. As shown in FIG. 27 and FIG. 28, when each first air cushion portion 510 and each second air cushion portion 520 are fixed and aligned side by side, each second connecting surface 524 is connected to each first connecting surface 514. A dividing line L5 is defined between the first connecting surfaces 514 and the second connecting surfaces 524. The first air cushion portions 510 are connected to each other and aligned side by side along the dividing line L5, and the second air cushion portions 520 are connected to each other and aligned side by side along the dividing line L5. A central axis L6 is defined between each first air cushion portion 510 and each second air cushion portion 520, passing through the dividing line L5. The central axis L6 is located between each first inner surface 511 and each second inner surface 521.

Figure 29:
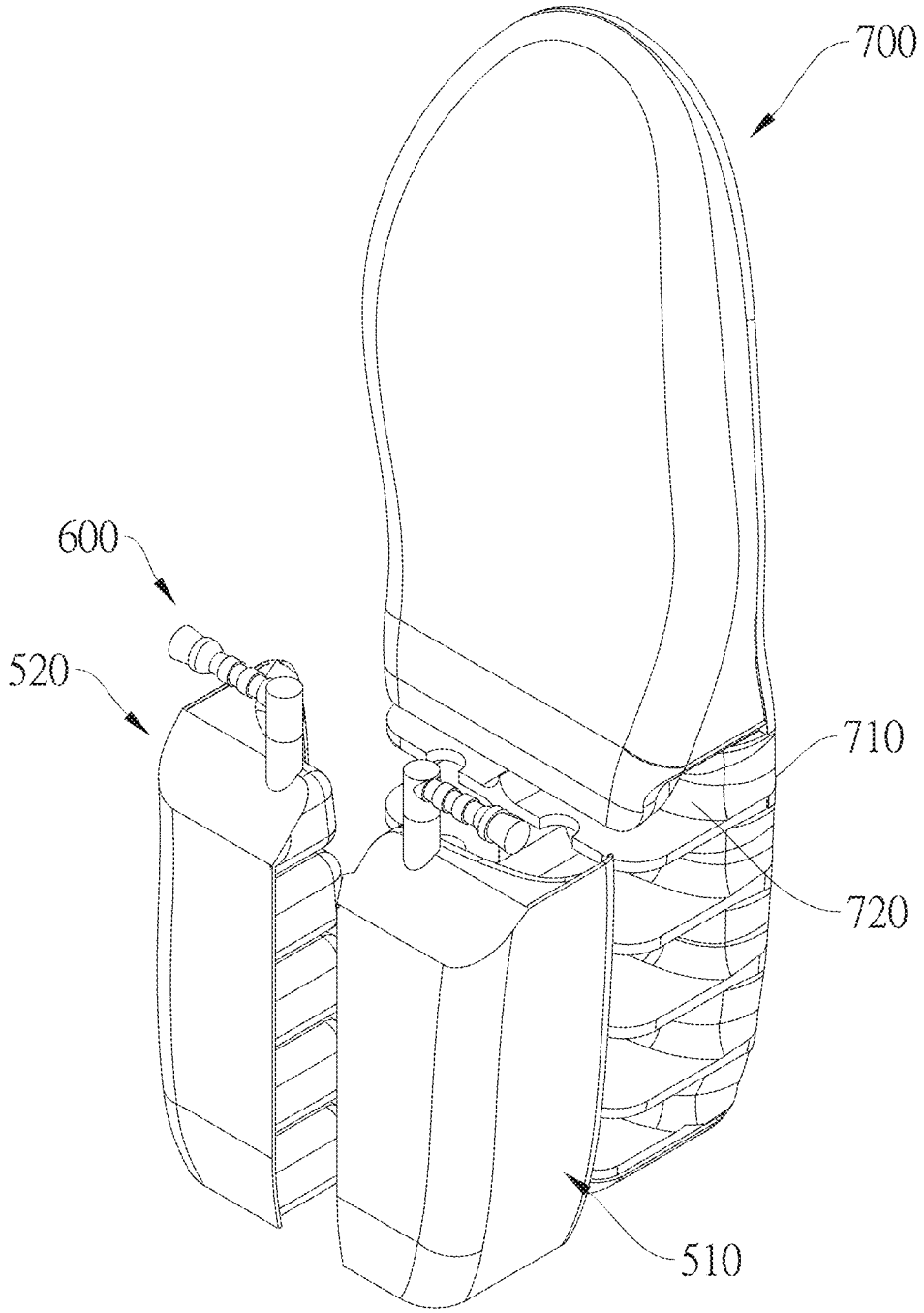
FIG. 29 a perspective view of the curved surface air cushion product, paired with the foam shoe body, according to the sixth embodiment of the present invention.
Figure 30:
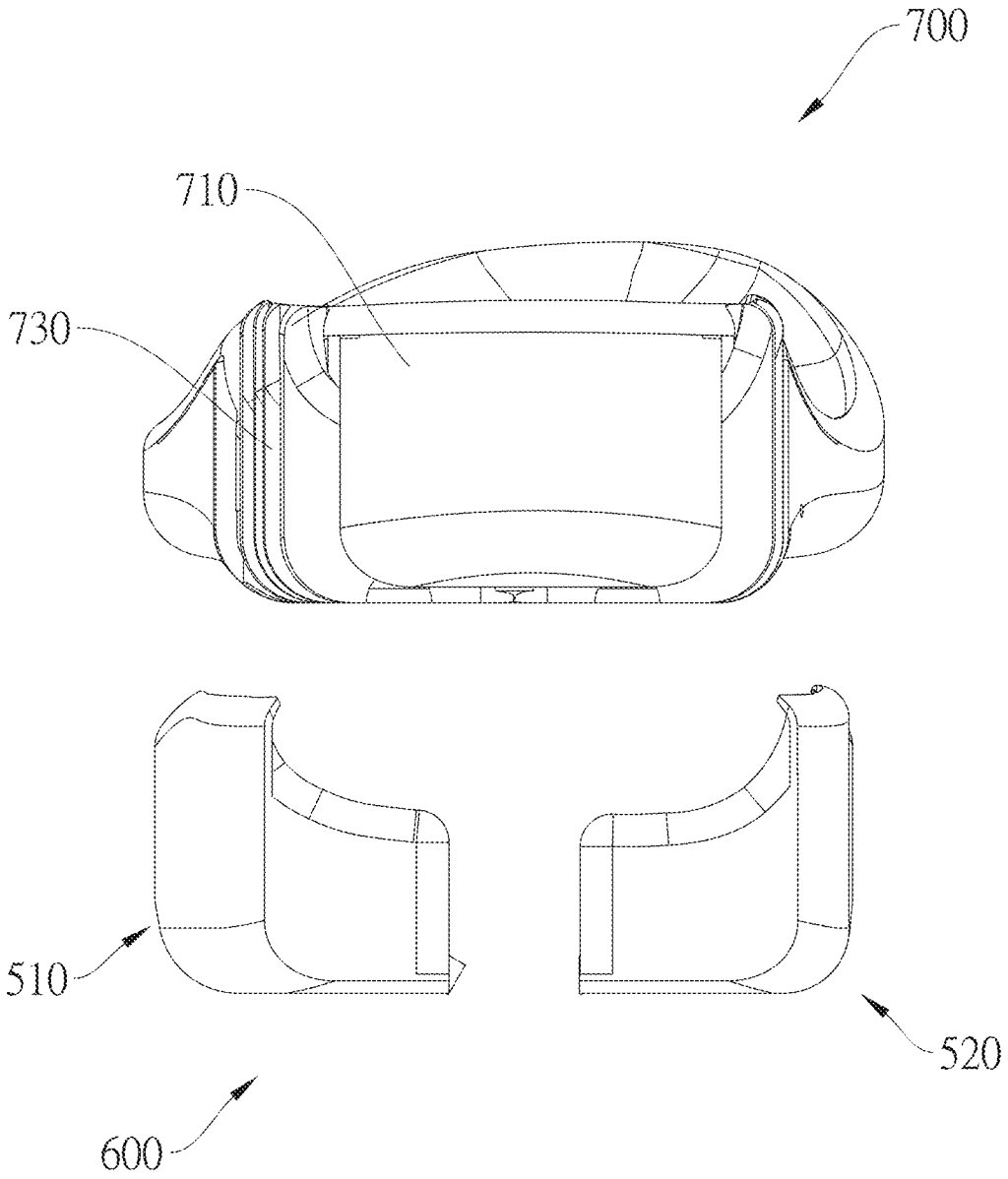
FIG. 30 a side view of the curved surface air cushion product, paired with the foam shoe body, according to the sixth embodiment of the present invention.

Moreover, as shown in FIG. 29, the curved surface air cushion product 600 is a foam shoe body 700 combined with the three-dimensional curved surface air cushion module 500, wherein the foam shoe body 700 is integrally foamed. The combination of the three-dimensional curved surface air cushion module 500 and the foam shoe body 700 forms a shoe outsole, similar to the fourth embodiment. As shown in FIG. 29 and FIG. 30, a heel portion 710 of the foam shoe body 700 has a plurality of accommodating grooves 720. The accommodating grooves 720 correspond to the contours and arrangement of the first air cushion portions 510 and the second air cushion portions 520 of the curved surface air cushion product 500. The first air cushion portions 510 and the second air cushion portions 520 are each fixed in the respective accommodating grooves 720. A plurality of walls of the accommodating grooves 720 is inserted into the first gaps 517 and the first clamping grooves 518 of the first air cushion portions 510, as well as the second gaps 527 and the second clamping grooves 528 of the second air cushion portions 520. Each accommodating groove 720 has a side opening 730. The first outer surfaces 512 of the first air cushion portions 510 and the second outer surfaces 522 of the second air cushion portions 520 are exposed through the side openings 730 of the accommodating grooves 720. This arrangement enhances the visual aesthetics of the foam shoe body 700.

It must be pointed out that the embodiments described above are only some preferred embodiments of the present invention. All equivalent structures which employ the concepts disclosed in this specification and the appended claims should fall within the scope of the present invention.

What is claimed is:

1. A three-dimensional curved surface air cushion module, comprising:

a first air cushion portion having a first outer surface, a first curved surface, and a first connecting surface, wherein the first outer surface has a first upper edge and a first lower edge respectively located on two ends of the first outer surface; the first curved surface is connected to the first upper edge of the first outer surface, and the first connecting surface is connected to the first lower edge of the first outer surface; and a second air cushion portion pivotally connected to the first air cushion portion, wherein the second air cushion portion has a second outer surface, a second curved surface, and a second connecting surface; the second outer surface has a second upper edge and a second lower edge respectively located on two ends of the second outer surface; the second curved surface corresponds to the contour and position of the first curved surface; the second curved surface is connected to the second upper edge of the second outer surface; the second connecting surface is connected to the second lower edge of the second outer surface; the second connecting surface is connected to the first connecting surface; a pivot fold line is defined, corresponding to a junction between the first connecting surface and the second connecting surface;

wherein the first air cushion portion and the second air cushion portion are pivoted along the pivot fold line, so that the first air cushion portion and the second air cushion portion open relative to each other; the first outer surface and the second outer surface tilt relative to each other; a first height is defined between the first upper edge and the first lower edge, wherein the first height is less than a wall height of the first outer surface; a second height is defined between the second upper edge and the second lower edge, wherein the second height is less than a wall height of the second outer surface, wherein a central axis is defined between the first air cushion portion and the second air cushion portion, passing through the pivot fold line; a first reference line is defined, tangent to a first valley reference point of the first curved surface; the first reference line passes through the first outer surface and is perpendicular to the central axis; the first upper edge and the first lower edge of the first outer surface are located on two sides of the first reference line; a second reference line is defined, tangent to a second valley reference point of the second curved surface; the second reference line passes through the second outer surface and is perpendicular to the central axis; the second upper edge and the second lower edge of the second outer surface are located on two sides of the second reference line, the first air cushion portion has a first upper edge distance, which is a distance between the first reference line and the first upper edge; the first air cushion portion has a first lower edge distance, which is a distance between the first reference line and the first lower edge; the first upper edge distance is less than the first lower edge distance; a combination of the first upper edge distance and the first lower edge distance defines the first height; the second air cushion portion has a second upper edge distance, which is a distance between the second reference line and the second upper edge; the second air cushion portion has a second lower edge distance, which is a distance between the second reference line and the second lower edge; the second upper edge distance is less than the second lower edge distance; and a combination of the second upper edge distance and the second lower edge distance defines the second height.

2. The three-dimensional curved surface air cushion module as claimed in claim 1, wherein the first air cushion portion has a first inner surface; the first inner surface and the first outer surface are located on two opposite sides of the first air cushion portion; the second air cushion portion has a second inner surface; the second inner surface and the second outer surface are located on two opposite sides of the second air cushion portion; the first inner surface and the second inner surface face each other; the central axis is located between the first inner surface and the second inner surface.

3. The three-dimensional curved surface air cushion module as claimed in claim 2, wherein when the first air cushion portion and the second air cushion portion are pivotally opened along the pivot fold line, a first angle and a second angle are provided; the first angle is provided between the first inner surface and the central axis; the second angle is provided between the second inner surface and the central axis; the first angle and the second angle are each greater than or equal to 10 degrees and less than or equal to 45 degrees.

4. The three-dimensional curved surface air cushion module as claimed in claim 2, wherein the number of the first air cushion portion and the number of the second air cushion portion are plural; the first air cushion portions are connected to each other and aligned side by side along the pivot fold line, and the second air cushion portions are connected to each other and aligned side by side along the pivot fold line; the first connecting surfaces are coplanar with the first outer surfaces; the second connecting surfaces are coplanar with the second outer surfaces; a first gap is provided between every two adjacent first air cushion portions; a first clamping groove is provided between every two adjacent first air cushion portions; each first clamping groove is recessed from each first curved surface toward each first connecting surface within the corresponding first gap; each first clamping groove is disposed on the first front surface of one of the first air cushion portions and the first rear surface of an adjacent first air cushion portion; a second gap is provided between every two adjacent second air cushion portions; a second clamping groove is provided between every two adjacent second air cushion portions; each second clamping groove is recessed from each second curved surface toward each second connecting surface within the corresponding second gap; each second clamping groove is disposed on the second front surface of one of the second air cushion portions and the second rear surface of an adjacent second air cushion portion.

5. The three-dimensional curved surface air cushion module as claimed in claim 4, further comprising a plurality of first axial communication portions, a plurality of second axial communication portions, and a lateral communication portion; each first axial communication portion is disposed in each first gap to communicate with every two adjacent first air cushion portions; each second axial communication portion is disposed in each second gap to communicate with every two adjacent second air cushion portions; the lateral communication portion is disposed between the first inner surface of one of the first air cushion portions and the second inner surface of an adjacent second air cushion portion, enabling the first air cushion portions and the second air cushion portions to communicate with each other through the lateral communication portion.

6. The three-dimensional curved surface air cushion module as claimed in claim 4, further comprising a first fluid-filled portion and a second fluid-filled portion; the first fluid-filled portion is disposed on one of the first air cushion portions and is used to controllably fill fluid into the first air cushion portions; the second fluid-filled portion is disposed on one of the second air cushion portions and is used to controllably fill fluid into the second air cushion portions.

* * * * *